US005845185A

United States Patent [19]

Sakagami et al.

[11] Patent Number: 5,845,185

[45] Date of Patent: Dec. 1, 1998

[54] IMAGE FORMING APPARATUS

[75] Inventors: Hidekazu Sakagami, Sakurai; Hideo Matsuda, Nara; Osamu Fujimoto, Yamatokoriyama; Atsushi Ide, Nara; Kazuyuki Ohnishi, Yamatokoriyama, all of Japan

[73] Assignee: Sharp Kabushiki Kaisha, Osaka, Japan

[21] Appl. No.: 792,759

[22] Filed: Feb. 4, 1997

[30] Foreign Application Priority Data

Mar. 19, 1996 [JP] Japan ..... 8-063508
Mar. 19, 1996 [JP] Japan ..... 8-063513

[51] Int. Cl.[6] ..... G03G 15/14

[52] U.S. Cl. ..... 399/302; 399/308; 399/303

[58] Field of Search ..... 399/302, 299, 399/306, 303, 308

[56] References Cited

U.S. PATENT DOCUMENTS 4,931,839 6/1990 Tompkins et al. .
5,276,490 1/1994 Bartholmae et al. .
5,428,429 6/1995 Fletcher .
5,572,303 11/1996 Arimoto ..... 399/303

FOREIGN PATENT DOCUMENTS 4287070 10/1992 Japan .

*Primary Examiner*—R. L. Moses

[57] ABSTRACT

An intermediate transfer drum has at least a drum main body having a volume resistivity of $10^4$ to $10^8$ Ωcm, and an insulating layer provided on an outer surface of the drum main body. A first transfer voltage applying roller is provided inside the intermediate transfer drum so as to be opposite to a photosensitive drum and so as to be in contact with an inner surface of the intermediate transfer drum. A transfer roller is provided inside the intermediate transfer drum so as to be opposite to a second transfer grounded roller and so as to be in contact with the inner surface of the intermediate transfer drum. By thus arranging an image forming apparatus wherein image formation is carried out with respect to recording paper through the intermediate transfer drum, an optimal first transfer voltage can be applied from the photosensitive drum to the intermediate transfer drum, while an optimal second transfer voltage can be applied from the intermediate transfer drum to the recording medium. As a result, the first transfer and the second transfer are individually and simultaneously carried out. Furthermore, since the intermediate transfer drum does not become large in size, it is avoidable that the image forming apparatus becomes bulkier, while the lowering of the copying speed can also be suppressed.

48 Claims, 21 Drawing Sheets

IMAGE FORMING APPARATUS

FIELD OF THE INVENTION

The present invention relates to an image forming apparatus, for example, a copying machine, or a laser printer. The present invention more particularly relates to an image forming apparatus which carries out image formation by projecting a laser beam onto a photosensitive element so as to form a latent image on the photosensitive element, visualizing the latent image with toner so as to form a visual image, and transferring the toner image directly, or indirectly with the use of an intermediate transfer medium, onto a recording medium such as paper.

BACKGROUND OF THE INVENTION

Various types of image forming apparatuses, each forming images by projecting a light beam onto a photosensitive element and forming latent images thereon, have been proposed. Proposed as an image forming method for forming color images is a method whereby respective toner images (hereinafter referred to as monochromatic toner images) of four colors (yellow, cyanogen, magenta, and black) are transferred from a photosensitive drum onto an intermediate transfer medium so that they overlap each other thereon and a resultant toner image (hereinafter referred to as multicolored toner image) thus formed is transferred onto a recording medium in a single step. Another is a method whereby monochromatic toner images are respectively and directly transferred from the photosensitive drum onto a recording medium which is held on a transfer medium, so that the monochromatic toner images overlap each other on the recording medium.

However, by the former method, transfer efficiency deteriorates since transferring is carried out twice, first, from the photosensitive drum to the intermediate transfer medium, and second, from the intermediate transfer medium to the recording medium. Therefore, the latter method is more frequently applied, especially in the case where priority is given to image quality and image forming speed.

FIG. 19 illustrates a schematic arrangement of an image forming apparatus for forming multicolored images by the latter method.

The image forming apparatus 100 has a transfer drum 101 composed of only an insulating layer. Inside the transfer drum 101, a corona charger 102 and a corona charger 104 are separately provided. The corona charger 102 causes recording paper 108 as a recording medium to be adsorbed to the transfer drum 101. The corona charger 104 causes a toner image formed on a surface of a photosensitive drum 103 to be transferred onto the recording paper 108. In other words, the adsorption of the recording paper 108 to the transfer drum 101 and the transfer of the toner images from the photosensitive drum 103 to the recording paper 108 are separately conducted in this image forming apparatus.

In such image forming apparatus, electric power which causes a potential difference necessary for transfer and adsorption is augmented, in the case where the transfer drum 101 has a thicker insulating layer. Therefore, conventionally the transfer drum 101 has had a single-layer configuration, only having a thin insulating layer. In this case, however, a problem has arisen that due to the thinness, the transfer drum 101 does not have sufficient strength, and hence does not have sufficient durability. Besides, due to the thinness, the insulating layer tends to be broken when the transfer drum 101 is replaced with another new. Thus, also has arisen a problem that the transfer drum 101 is not easy to handle.

It is not impossible to make the transfer drum 101 have a greater strength with the thickness of the insulating layer remaining the same, by decreasing the outer diameter of the transfer drum 101 and hence miniaturizing the transfer drum 101. However, it is necessary to provide a corona charger 105, a corona charger 106, a cleaning unit 107, etc. as well as the corona chargers 102 and 104, inside and outside the transfer drum 101. Since these elements are provided around the transfer drum 101, it is difficult to miniaturize the transfer drum 101. Note that the corona charger 105 separates the recording paper 108 from the transfer drum 101, the corona charger 106 removes electric charge from the transfer drum 101, and the cleaning unit 107 cleans the surface of the transfer drum 101.

On the other hand, the U.S. Pat. No. 5,276,490, "Buried Electrode Drum for an Electrophotographic Print Engine", discloses an image forming apparatus which has a transfer drum wherein a plurality of electrodes are provided between a non-conductive support member and a resistivity layer covering a surface of the non-conductive support member, the electrodes being provided along the longitudinal axis of the drum. With this arrangement, it is possible to simplify the arrangement of the charging devices around the transfer drum. However, it is not easy to provide the electrodes on the transfer drum along the longitudinal axis. Therefore, there is still a problem that productivity of the transfer drum is not good.

The Japanese Publication for Unexamined Patent Application No. 4-287070/1992 discloses an intermediate transfer drum for the use in a color image forming apparatus. The intermediate transfer drum has a triple layer configuration, wherein a metal drum, a conductive sponge, and a dielectric film are provided in this order from inside to outside. FIG. 20 illustrates a schematic arrangement of an image forming apparatus having the described intermediate transfer drum.

An intermediate transfer drum 114 is composed of a metal drum 111, a conductive sponge 112, and a dielectric film 113, which are provided in this order from inside to outside. A high voltage power supply 122 and a ground terminal 123 are switchably connected to the metal drum 111. A transfer roller 115 is connected with a high voltage power supply 115*a* for applying a voltage having a polarity reverse to that of toner.

In the image forming apparatus 110 thus arranged, a monochromatic toner image of a first color is formed on a photosensitive drum 116 by a development device 121. The monochromatic toner image of the first color is transferred from the photosensitive drum 116 to the intermediate transfer drum 114 at a position P where the photosensitive drum 116 and the intermediate transfer drum 114 come into contact, due to a voltage having a polarity reverse to that of the toner which is simultaneously applied to the metal drum 111 by the high voltage power supply 122.

Sequentially a monochromatic toner image of a second color is formed on the photosensitive drum 116 by the development device 119. The monochromatic toner image of the second color is transferred onto the intermediate transfer drum 114 so that the monochromatic toner image of the second color overlap the monochromatic toner image of the first color which has already been transferred thereon. Likewise, monochromatic toner images of a third color and a fourth color are formed and transferred onto the intermediate transfer drum 114, thereby resulting in that a multicolored toner image is formed on the intermediate transfer drum 114.

When an end of the multicolored toner image on the intermediate transfer drum 114 moves to a second transfer position Q between the intermediate drum 114 and the transfer roller 115, recording paper 117 has been already there. When the recording paper 117 passes the second transfer position Q, the metal drum 111 is connected to the ground terminal 123, thereby becoming grounded, while a voltage having a polarity reverse to that of the toner is applied to the transfer roller 115 by the high voltage power supply 115*a*. As a result, the multicolored toner image is transferred from the intermediate transfer drum 114 to the recording paper 117.

Thus, in the image forming apparatus 110, so that the first transfer and the second transfer are carried out, the high voltage power supply 122 and the grounded terminal 123 are switchably connected with the metal drum 111.

However, according to the arrangement of the image forming apparatus 110, the respective transfers at the first transfer position P and the second transfer position Q are carried out at optimal conditions by the use of the high voltage power supply 122 and the high voltage power supply 115*a*. Therefore, it is impossible to simultaneously carry out the respective transfers at the first and second transfer positions P and Q. To solve this problem, it is necessary that a distance between the first and second transfer positions P and Q on the surface of the intermediate transfer drum 114 should be set greater than a maximum usable length of the recording paper 117 in the moving direction. This requirement causes the intermediate transfer drum 114 to have a greater diameter, thereby leading to a problem that the image forming apparatus becomes bulkier. In addition, a copy speed lowers in a continuous copying operation, since a distance great enough is necessary between sheets of the recording paper 117.

FIG. 21 is a schematic view illustrating an arrangement of an image forming apparatus 130 wherein monochromatic toner images are directly transferred from a photosensitive drum to recording paper. A transfer drum 134 has a triple-layer configuration, being composed of a metal drum 131, a conductive sponge 132, and a dielectric film 133, which are provided in this order from inside to outside. A high voltage power supply 138 is connected to the metal drum 131.

In this case, the recording paper 137 transported is charged at an adsorption position R between a ground roller 135 which is grounded and the transfer drum 134, and the recording paper 137 is electrostatically adsorbed to the transfer drum 134. The recording paper 137 thus adsorbed to the transfer drum 134 is transported to the transfer position S where the photosensitive drum 136 and the transfer drum 134 come into contact, and there the monochromatic toner images are transferred from the photosensitive drum 136 onto the recording paper 137.

In other words, in the image forming apparatus 130, the adsorption of the recording paper 137 to the transfer drum 134 and the transfer of the monochromatic toner images from the photosensitive drum 136 to the recording paper 137 on the transfer drum 134 are both carried out by the use of the single high voltage power supply 138 connected to the metal drum 131.

According to the arrangement of the image forming apparatus 130, respective potential differences at the adsorption position R and the transfer position S in accordance with optimal image forming conditions are not necessarily equal to each other. In other words, (1) the necessary potential difference when the monochromatic toner images are transferred from the photosensitive drum 136 to the recording paper 137 on the transfer drum 134, and (2) the necessary potential difference when the recording paper 137 is adsorbed to the transfer drum 134, are not necessarily equal to each other. The potential differences also vary with thickness or material of the recording paper 137. Therefore, it is impossible to obtain each optimal potential difference by applying a same voltage.

To obtain the potential difference suitable for the adsorption and the potential difference suitable for the transfer, it is necessary (1) to provide two high voltage power supplies 138 which are switchably connected to the metal drum 131, and (2) to set the adsorption position R and the transfer position S a distance apart from each other which is greater than a length of the recording paper 137 of a maximum size dealt with by the image forming apparatus 130. As a result, arises a problem that the outer diameter of the transfer drum 134 becomes greater and hence the image forming apparatus becomes bulkier. Besides, in the case where copying with respect to first and second sheets of the recording paper 137 is sequentially carried out in this order, the adsorption of the second sheet cannot be started until the transfers of the toner images onto the first sheet which has been adsorbed are finished. Therefore, it is necessary that the sheets of the recording paper 137 have a greater distance therebetween, and this leads to a problem that the copy speed lowers in a continuous copying operation.

SUMMARY OF THE INVENTION

The first object of the present invention is to provide an image forming apparatus which is arranged so that (1) toner images are transferred from a photosensitive drum to recording paper through an intermediate transfer medium, and (2) a first transfer and a second transfer are individually and simultaneously carried out with an optimal first transfer voltage and an optimal second transfer voltage, respectively.

The second object of the present invention is to provide an image forming apparatus which is arranged so that toner images are directly transferred from a photosensitive drum to recording paper, (2) adsorption of the recording paper to a transfer medium and transfer of a toner image to the recording paper are individually and simultaneously carried out with respective optimal voltages for the adsorption and the transfer.

The third object of the present invention is to provide an image forming apparatus (1) which is not bulky and (2) whose copying speed is not low.

To achieve the first and third objects, the image forming apparatus of the present invention is characterized in comprising (1) at least one photosensitive drum, (2) an intermediate transfer medium onto which a toner image formed on the photosensitive drum is transferred, (3) pressing means for pressing a recording medium against the intermediate transfer medium, (4) at least one first electrode capable of causing a first potential difference to be generated between the first electrode and the photosensitive drum, the first electrode being provided inside the intermediate transfer medium so as to be opposite to the photosensitive drum and so as to be in contact with an inner surface of the intermediate transfer medium, and (5) a second electrode capable of causing a second potential difference to be generated between the second electrode and the pressing means, the second electrode being provided inside the intermediate transfer medium so as to be opposite to the pressing means and so as to be in contact with the inner surface of the intermediate transfer medium, wherein a first transfer and a second transfer are carried out so that image formation is carried out, during the first transfer a toner image being transferred from the photosensitive drum to the intermediate transfer medium in accordance with the first potential difference, during the second transfer a toner image being transferred from the intermediate transfer medium to the recording medium in accordance with the second potential difference.

According to the above arrangement, the toner image formed on the photosensitive drum is transferred onto the intermediate transfer medium, in accordance with the first potential difference between the intermediate transfer medium and the first electrode which is provided inside the intermediate transfer medium so as to be opposite to the photosensitive drum and so as to be in contact with an inner surface of the intermediate transfer medium.

Further, the toner image transformed on the intermediate transfer medium is transferred onto the recording medium, in accordance with the second potential difference between the pressing means and the second electrode which is provided inside the intermediate transfer medium so as to be opposite to the pressing means and so as to be in contact with an inner surface of the intermediate transfer medium.

According to this arrangement, since application of a voltage to the first electrode and application of a voltage to the second electrode are not carried out by the use of a single voltage supply system, unlike the conventional arrangement. Therefore, the respective voltages applied during the first and second transfers are individually and easily controlled. As a result, with the above-described arrangement, the first transfer and the second transfer can be individually and simultaneously carried out. Furthermore, since respective adequate voltages are applied during the first transfer and the second transfer, the image formation can be effectually carried out.

Besides, since the first transfer and the second transfer are individually and simultaneously carried out, the intermediate transfer medium per se does not become bulkier, unlike the conventional arrangement wherein the first transfer and the second transfer are both controlled by a single voltage supplying system. Therefore, with the above arrangement, it is possible to prevent the image forming apparatus from becoming bulkier, while to prevent the copying speed from lowering, for example, even during a continuous copying operation.

To achieve the second and third objects, an image forming apparatus of the present invention is characterized in comprising (1) at least one photosensitive drum, (2) a transfer medium for holding a recording medium and for transporting the recording medium to the photosensitive drum, (3) pressing means for pressing the recording medium against the transfer medium, (4) at least one first electrode capable of causing a first potential difference to be generated between the first electrode and the photosensitive drum, the first electrode being provided inside the transfer medium so as to be opposite to the photosensitive drum and so as to be in contact with an inner surface of the transfer medium, and (5) a second electrode capable of causing a second potential difference to be generated between the second electrode and the pressing means, the second electrode being provided inside the transfer medium so as to be opposite to the pressing means and so as to be in contact with the inner surface of the transfer medium, wherein the recording medium is adsorbed to the transfer medium in accordance with the second potential difference, while a toner image formed on the photosensitive drum is transferred onto the recording medium adsorbed to the transfer medium in accordance with the first potential difference.

According to the above-described arrangement, the recording medium is adsorbed to the transfer medium in accordance with the second potential difference between the pressing means and the second electrode which is provided inside the transfer medium so as to be opposite to the pressing means and so as to be in contact with the inner surface of the intermediate transfer medium.

Besides, the toner image formed on the photosensitive drum is transferred onto the recording medium in accordance with the first potential difference between the transfer medium and the first electrode provided inside the transfer medium so as to be opposite to the photosensitive drum and so as to be in contact with the inner surface of the intermediate transfer medium.

Here, since the adsorption and the transfer are not carried out by the use of a single voltage supply system. Therefore, the respective voltages applied during the adsorption and the transfer are individually and easily controlled. As a result, with the above-described arrangement, the adsorption and the transfer can be individually and simultaneously carried out. Furthermore, since respective adequate voltages are applied during the adsorption and the transfer, the image formation can be effectually carried out.

Besides, since the adsorption and the transfer are individually and simultaneously carried out, the transfer medium per se does not become bulkier, unlike the conventional arrangement wherein the adsorption and the transfer are controlled by a single voltage supplying system. Therefore, with the above arrangement, it is possible to prevent the image forming apparatus from becoming bulkier, while to prevent the copying speed from lowering, for example, even during a continuous copying operation.

For a fuller understanding of the nature and advantages of the invention, reference should be made to the ensuing detailed description taken in conjunction with the accompanying drawings.

DESCRIPTION OF THE PREFERRED EMBODIMENTS

[First Embodiment]

The following description will discuss an embodiment of the present invention, while referring to FIGS. 1 through 6. Discussed as an embodiment of the present invention is an image forming apparatus arranged so that a toner image is transferred from a photosensitive drum onto recording paper through an intermediate transfer medium.

Figure 1:
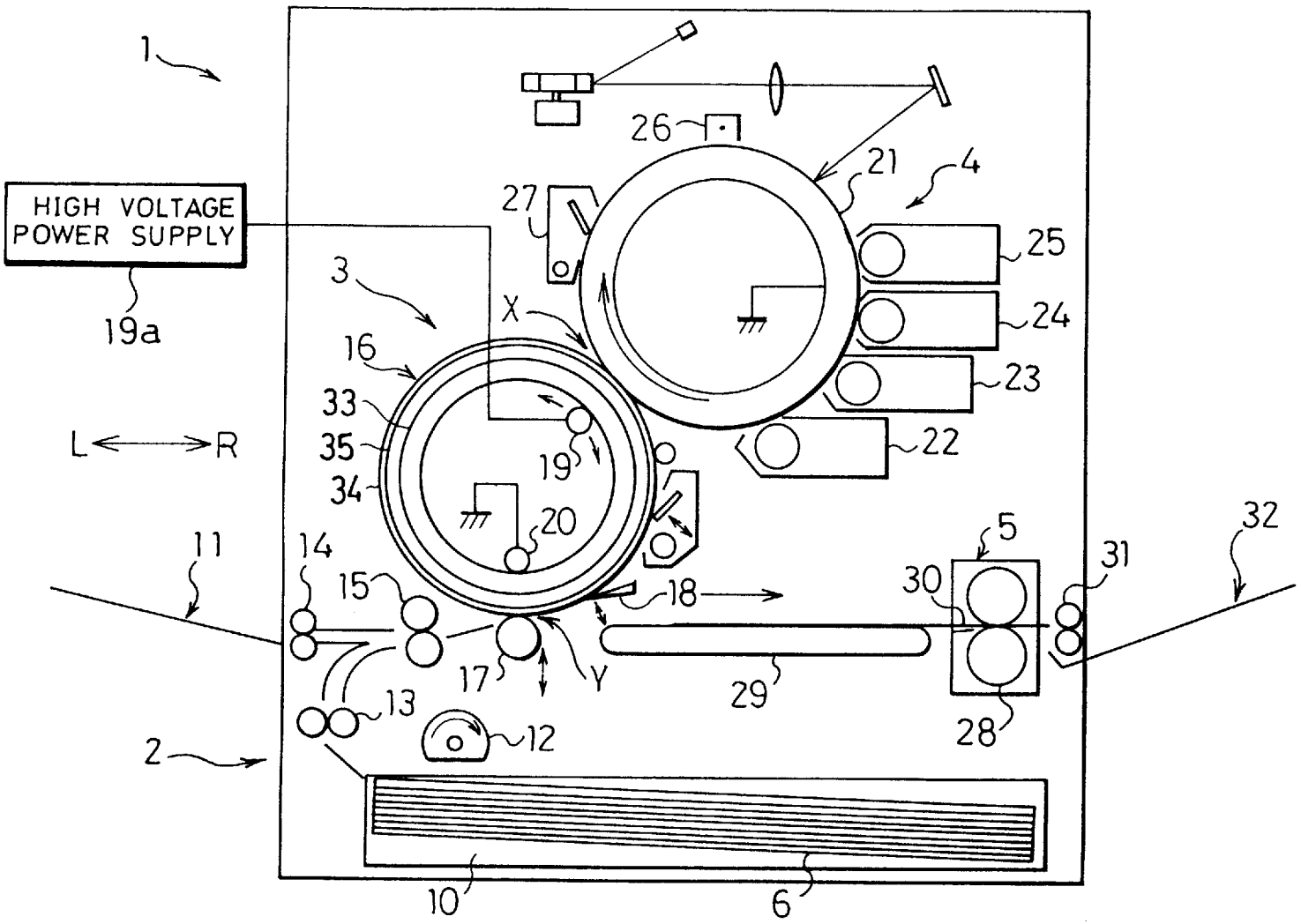
FIG. 1 is a cross-sectional view illustrating an arrangement of an image forming apparatus in accordance with an embodiment of the present invention.

The image forming apparatus 1 of the present embodiment has a paper feed unit 2, a transfer unit 3, a development unit 4, and a fixing unit 5, as illustrated in FIG. 1. The paper feed unit 2 stores sheets of the recording paper 6 (recording medium) onto which the toner images are transferred, while feeds the recording paper 6 to the transfer unit 3. The transfer unit 3 transfers the toner image which is formed on a photosensitive drum 21 (described later) onto an intermediate transfer drum 16 (described later). The development unit 4 forms the toner image in accordance with a latent image which is formed on the photosensitive drum 21 with projection of a laser beam. The fixing unit 5 fixes the toner image transferred on the recording paper 6 by fusing toner particles thereon. Thus, (1) a first transfer from the photosensitive drum 21 of the development unit 4 to the intermediate transfer drum 16 of the transfer unit 3, and (2) a second transfer from the intermediate transfer drum 16 onto the recording paper 6 are carried out. With the first and second transfers, pictures are formed on the recording paper 6.

Note that a position at which the photosensitive drum 21 and the intermediate transfer drum 16 come into contact so that the first transfer is carried out is hereinafter referred to as a first transfer position X, while a position between the intermediate transfer drum 16 and a transfer roller 17 (described later) where the second transfer is carried out with respect to the recording paper 6 is hereinafter referred to as a second transfer position Y.

The following description will discuss an arrangement of the image forming apparatus in detail, while referring to FIG. 1.

The paper feed unit 2 includes a paper cassette 10 and a hand feeding unit 11. The paper cassette 10 is removably provided in the lowest part of the image forming apparatus 1. Sheets of the recording paper 6 stored in the paper cassette 10 are supplied therefrom to the transfer unit 3. The hand feeding unit 11 is provided on a front (a side in a direction L which is designated by an arrow) of the image forming apparatus 1. To the hand feeding unit 11, sheets of the recording paper 6 are supplied by hand one by one.

There are provided a pickup roller 12, a pre-feed roller (hereinafter referred to as PF roller) 13, a hand feeding roller 14, and a register roller 15, between the paper feed unit 2 and the transfer unit 3.

The pickup roller 12 sends out sheets of the recording paper 6 from the top of the paper cassette 10 one by one. The PF roller 13 transports the recording paper 6 sent out by the pickup roller 12 to the register roller 15. The hand feeding roller 14 transports the recording paper 6 supplied from the hand feeding unit 11 to the register roller 15. The register roller 15 temporarily stops the recording paper 6 transported by the PF roller 13 or the hand feeding roller 14 just before the transfer unit 3, so that the recording paper 6 is transported to the transfer unit 3 at a predetermined timing.

The paper cassette 10 includes a push-up member (not shown) on which the recording paper 6 is placed, the push-up member having a spring or the like so that the recording paper 6 placed thereon is pushed up. The top of sheets of the recording paper 6 accumulated in the paper cassette 10 is pressed against the pickup roller 12, being pushed up by the push-up member. The sheets of the recording paper 6 are sent out one by one to the PF roller 13, with the rotation of the pickup roller 12 in a direction indicated by an arrow in the figure, and then, each of them is transported to the register roller 15. On the other hand, in the case where the recording paper 6 is supplied from the hand feeding unit 11, the recording paper 6 is transported by the hand feeding roller 14 to the register roller 15.

The transfer unit 3 has the intermediate transfer drum 16 (intermediate transfer medium), the transfer roller 17 (pressing means), and a detaching pawl 18. The transfer roller 17 and the detaching pawl 18 are provided around the intermediate transfer drum 16. Onto the intermediate transfer drum 16, toner images formed on the photosensitive drum 21 are transferred. The transfer roller 17 presses the recording paper 6 against the intermediate transfer drum 16, while applies a voltage from a high voltage power supply 17*a* (described later) to the intermediate transfer drum 16. The detaching pawl 18 is arranged so that it comes in contact with the intermediate transfer drum 16 after the second transfer and detaches the recording paper 6 therefrom, while it is not in contact with the intermediate transfer drum 16 in the other occasions.

Inside the intermediate transfer drum 16, there are provided a first transfer voltage applying roller 19 (first electrode) and a second transfer grounded roller 20 (second electrode) at a position opposite to the photosensitive drum 21 and at a position opposite to the transfer roller 17, respectively, so as to be in contact with an inner surface of the intermediate transfer drum 16. The first transfer voltage applying roller 19 is connected to the high voltage power supply 19*a,* and applies a first transfer voltage to the intermediate transfer drum 16 at the first transfer position X. The second transfer grounded roller 20 is grounded at the second transfer position Y.

Surfaces of the first transfer voltage applying roller 19 and the second transfer grounded roller 20 are covered with an elastic substance, for example, urethane rubber, or silicon. Therefore, neither the first transfer voltage applying roller 19 nor the second transfer grounded roller 20 causes vibration which may reversely affect the intermediate transfer drum 16, and hence it is possible to stably rotate the intermediate transfer drum 16.

It is arranged that the toner images are transferred onto the surface of the intermediate transfer drum 16 with static electricity. Therefore, there are further provided a charge removing unit, a cleaning unit, or the like, around the intermediate transfer drum 16. The charge removing unit removes charges remaining on the surface of the intermediate transfer drum 16. The cleaning unit removes toner particles or the like adhering to the surface of the intermediate transfer drum 16. On each end of an axis of the intermediate transfer drum 16, there is provided a flange made of insulating material. The intermediate transfer drum 16 is installed in a main body flame by the intermediation of bearings provided on the flanges. Being thus arranged, the intermediate transfer drum 16 is rotatably fixed to the main body flame while it is insulated from the main body flame. Therefore, electric influence from other devices is shut out, while the surface of the intermediate transfer drum 16 is electrically stabilized.

In the development unit 4, the photosensitive drum 21 is rotatably provided so as to be in contact with the intermediate transfer drum 16 at the first transfer position X. The photosensitive drum 21 is composed of an aluminum tube whose outer surface is covered with OPC (organic photoconductive conductor) film. This aluminum tube is grounded.

Around the photosensitive drum 21, developing elements 22, 23, 24, and 25, a charger 26, a cleaning unit 27, and an image space eraser (not shown) are radially provided. The developing elements 22, 23, 24, and 25 contain toners of yellow, magenta, cyanogen, and black, respectively. The charger 26 charges the surface of the photosensitive drum 21. The cleaning unit 27 removes toner particles remaining on the surface of the photosensitive drum 21.

For each color, each monochromatic toner image is individually formed on the photosensitive drum 21. In other words, for each color, charging, exposure, development and transfer are carried out with respect to the photosensitive drum 21. Therefore, a monochromatic toner image of one color on the photosensitive drum 21 is transferred onto the intermediate transfer drum 16 during one rotation of the intermediate transfer drum 16, and hence a multicolored toner image is obtained after four times of rotation of the intermediate transfer drum 16.

Note that the exposure of the surface of the photosensitive drum 21 is carried out with projection of a light beam onto the photosensitive drum 21, for example, by projecting a laser beam on an area between the charger 26 and the developing element 25 of the photosensitive drum 21.

The fixing unit 5 has a fixing roller 28, a transport guide 29, and a fixing guide 30. The fixing roller 28 fuses toner particles at a predetermined temperature with a predetermined pressure, so that the multicolored toner image is fixed onto the recording paper 6. The transport guide 29 and the fixing guide 30 guide, to the fixing roller 28, the recording paper 6 which was detached from the intermediate transfer drum 16 by the detaching pawl 18. In the fixing unit 5, there are provided a discharge roller 31 and a discharge tray 32 on a side to a downstream of the direction of transport of the recording paper 6, so that after fixing operations the recording paper 6 is discharged to the discharge tray 32 and held therein.

Figure 2:
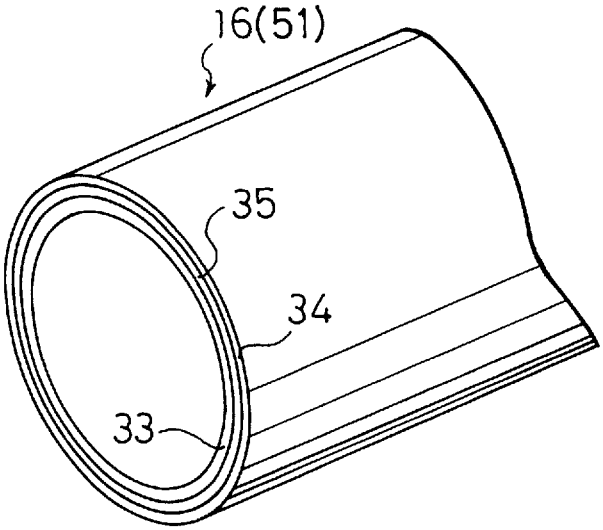
FIG. 2 is a perspective view illustrating a schematic arrangement of an intermediate transfer drum provided in the image forming apparatus.

The following description will discuss structure of the intermediate transfer drum 16, while referring to FIG. 2.

The intermediate transfer drum 16 is composed of a cylindrical drum main body (transfer medium main body) 33, an elastic layer 35 provided on an outer surface of the drum main body 33, and an insulating layer 34 provided on an outer surface of the elastic layer 35, as shown in FIG. 2.

The drum main body 33 is made of a resin, which is made by adding a conductive additive to base material so as to have a volume resistivity between that of conductive material and that of insulating material. This resin is hereinafter referred to as semiconductive resin. The elastic layer 35 is made of urethane foam, silicon, or the like. The insulating layer 34 having semiconductivity is made of polyvinylidene fluoride (PVDF), polyethylene terephthalate (PET), or the like.

In the case where different voltages are necessitated at the first transfer position X and the second transfer position Y, one voltage applied at one position may possibly interfere the other voltage applied at the other position. To prevent the interference, it is preferable that the semiconductive resin of the drum main body 33 has a volume resistivity of $10^4$ to $10^8$ Ωcm. The semiconductive resin may preferably have a thickness of 1 to 30 mm, considering requisite hardness and functions.

For the same reasons as above, it is necessary that the elastic layer 35 has a volume resistivity of $10^4$ to $10^8$ Ωcm. At the same time, so as to obtain a sufficient nip width, it is preferable that the elastic layer 35 has a thickness of 1 to 10 mm.

On the other hand, it is requisite that respective adequate charges should be retained (1) between the intermediate transfer drum 16 and the transfer roller 17 and (2) between the intermediate transfer drum 16 and the photosensitive drum 21. An adequate charge retention ability of the insulating layer 34, that is, capacitance c is given as:

$$c=\epsilon \times s/d$$

where $\epsilon$ represents a dielectric constant of the insulating layer 34, s represents a space of the insulating layer 34, and d represents a thickness of the insulating layer 34.

From the above equation, it is found that the thinner the insulating layer 34 is, the greater the capacitance c is. However, it is preferable that the insulating layer 34 has a uniform thickness of 50 μm to 300 μm, so that the insulating layer 34 has a uniform thickness and good productivity and durability of the insulating layer 34 is ensured.

In addition, in the case where the dielectric constant $\epsilon$ is small, the capacitance c becomes small as well, and causes transfer efficiency to be enhanced while causes an adsorption power to lower. In contrast, in the case where the dielectric constant $\epsilon$ is great, the capacitance c becomes great as well and causes transfer efficiency to be deteriorated while causes the adsorption power to increase. In the case where the thickness d is great and in the case where the thickness d is small, respective reverse results to those described above regarding the dielectric constant $\epsilon$ are obtained.

Therefore, from results of experiments, it is found that the insulating layer 34 may preferably have a dielectric constant of 8 to 12, in the case where the thickness d falls in the above range.

In the case where the insulating layer 34 has a too low resistance, a current component which runs due to circuit contact to which Ohm's law is applicable takes precedence over a current component which runs when the toner on the photosensitive drum 21 moves to the intermediate transfer drum 16. Therefore, a re-transfer occurs, namely, toner particles, which have moved to the intermediate transfer drum 16 at the first transfer position X, return to the photosensitive drum 21.

In the case where, contrary to the above case, the insulating layer 34 has a too high resistance, both the current components, namely, (1) the current component which runs due to circuit contact to which Ohm's law is applicable and (2) the current component which runs when the toner on the photosensitive drum 21 moves to the intermediate transfer drum 16, become small. Therefore, an insufficient quantity of toner moves to the intermediate transfer drum 16 at the first transfer position X, thereby causing defective transfer.

Therefore, it is found that the insulating layer 34 may preferably have a volume resistivity of $10^{12}$ to $10^{17}$ Ωcm, in the case where the thickness d falls in the above range.

Note that the above-described material such as polyvinylidene fluoride (PVDF) or polyethylene terephthalate (PET) has a dielectric constant $\epsilon$ and a volume resistivity which fall in the above respective ranges. Therefore, such material is used as suitable material for the insulating layer 34.

Note that the intermediate transfer drum 16 of the present embodiment has a triple-layer configuration, being composed of the drum main body 33, the elastic layer 35, and the insulating layer 34, but this is not a sole definite configuration. The elastic layer 35 is not necessarily indispensable. The intermediate transfer drum 16 may have a double-layer configuration, having the drum main body 33 and the insulating layer 34 which covers the outer surface of the drum main body 33. However, by providing the elastic layer 35, it is possible to more smoothly detach the recording paper 6 from the intermediate transfer drum 16 after the transfer of the multicolored toner image onto the recording paper, as described later.

According to the above arrangement, the first transfer voltage is supplied from the high voltage power supply 19*a* to an inside part of the intermediate transfer drum 16 at the first transfer position X, while a part of the intermediate transfer drum 16 at the second transfer position Y is grounded by the intermediation of the second transfer grounded roller 20. Therefore, a potential at the first transfer position X and that at the second transfer position Y differ from each other. Besides, since the intermediate transfer drum 16 has the drum main body 33 made of semiconductive resin inside, it is possible to maintain the potential difference between the first and second transfer positions X and Y. Therefore, the first and second transfers can be simultaneously carried out at respective potentials.

The following description will discuss a configuration of the transfer roller 17. Note that the transfer roller 17 has the following configuration in the case where negatively polarized toner is utilized, but the same theory as that described below can be applied in the case where positively polarized toner is utilized.

Figure 3:
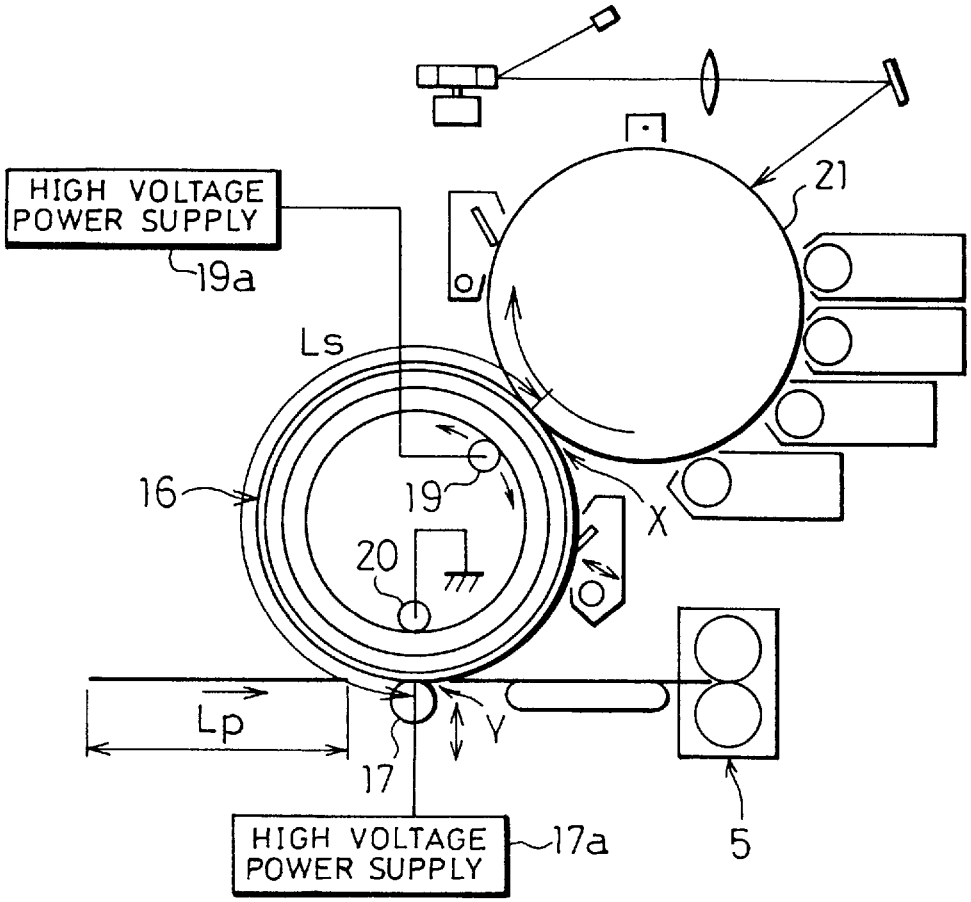
FIG. 3 is a cross-sectional view illustrating principal parts of the image forming apparatus.

The transfer roller 17 provided below the intermediate transfer drum 16 is connected to the high voltage power supply 17*a,* as illustrated in FIG. 3. The high voltage power supply 17*a* supplies a voltage having a polarity reverse to the polarity of the toner, i.e., a positive voltage, to the transfer roller 17. With this arrangement, when the recording paper 6 passes the second transfer position Y between the transfer roller 17 and the intermediate transfer drum 16, toner forming the multicolored toner image on the intermediate transfer drum 16 moves in a direction toward the transfer roller 17, thereby resulting in that the multicolored toner image is transferred onto the recording paper 6.

Note that in the present embodiment, it is possible to switch the polarity of the voltage applied to the transfer roller 17 at any time. In the case where the transfer roller 17 is continuously used for a long period of time, it sometimes occurs that a reverse surface of the recording paper 6 is soiled due to adhesion of unnecessary toner particles to the surface of the transfer roller 17. This problem is solved by causing the transfer roller 17 to come into contact with the intermediate transfer drum 16 when the recording paper is not passing the second transfer position Y, and applying a voltage having the same polarity of that of the toner. By doing this, unnecessary toner particles adhering to the transfer roller 17 are caused to move to the intermediate transfer drum 16, and the transfer roller 17 is cleaned. The unnecessary toner particles which have moved onto the intermediate transfer drum 16 are collected by the cleaning unit. Therefore, with the above-described arrangement wherein unnecessary toner particles adhering to the surface of the transfer roller 17 can be removed, it is avoidable that the reverse surface of the recording paper 6 is soiled, even in the case where the transfer roller 17 is continuously used for a long period of time.

The cleaning of the transfer roller 17 is carried out by pressing the transfer roller 17 against the intermediate transfer drum 16, immediately after a rear end of a resultant toner image on the intermediate transfer drum 16 after the transfer of the toner of the third color thereto passes the second transfer position Y. By doing this, it is enabled to allot a longer period of time to the cleaning operation. The action of pressing the transfer roller 17 against the intermediate transfer drum 16 during the cleaning operation does not differ from the action during the second transfer operation. Therefore, variations of the motions of the transfer roller 17 are not increased. Note that the detailed timings of the first transfer, the second transfer, and the cleaning operation of the transfer roller 17 will be described later.

The hardness of the surface of the transfer roller 17 is set higher than that of the elastic layer 35 of the intermediate transfer drum 16. With this arrangement, the intermediate transfer drum 16 deforms when the recording paper 6 passes the second transfer position Y so that the recording paper 6 curves along the transfer roller 17. As a result, the recording paper 6 is easily detached from the intermediate transfer drum 16 after the recording paper 6 passes the second transfer position Y.

During the image formation, it sometimes occurs that the toner image formed on the intermediate transfer drum 16 is distorted due to the contact and pressure by the transfer roller 17. To avoid this problem, there are provided, for example, solenoids (not shown) as driving means, each solenoid being at each end of the rotation axis of the transfer roller 17 in the apparatus of the present embodiment, so that the transfer roller 17 is mechanically pressed against and detached from the intermediate transfer drum 16. With this arrangement, the transfer roller 17 is allowed to have a stable nip width during the second transfer at the second transfer position Y, while the transfer roller 17 is kept a predetermined distance apart from the intermediate transfer drum 16, except during the second transfer.

The following description will discuss the motions of the intermediate transfer drum 16 during the first and second transfers.

During the first transfer, a toner image having negative charges is formed on the photosensitive drum 21. The toner image is moved to the first transfer position X at which the photosensitive drum 21 and the intermediate transfer drum 16 come into contact, with the rotation of the photosensitive drum 21.

At the first transfer position X, a voltage having a polarity reverse to that of the toner, i.e., a positive voltage, is applied from the high voltage power supply 19*a* to the first transfer voltage applying roller 19. This generates an electric field in a direction from the first transfer voltage applying roller 19 to the photosensitive drum 21, and hence causes the toner having the negative polarity to move onto the surface of the intermediate transfer drum 16. The toner image is thus transferred thereon. Note that the intermediate transfer drum 16 is pressed against the photosensitive drum 21 at the first transfer position X so as to have a predetermined nip width. A multicolored toner image of the four colors is formed on the intermediate transfer drum 16, by repeating the described process for four times, namely, one process per one color. This multicolored toner image is moved to the second transfer position Y between the intermediate transfer drum 16 and the transfer roller 17, with the rotation of the intermediate transfer drum 16.

During the second transfer, a voltage having a polarity reverse to that of the toner, i.e., a positive voltage, is applied from the high voltage power supply 17*a* to the transfer roller 17 when the recording paper 6 passes the second transfer position Y. This causes the toner having the negative polarity to move in a direction to the recording paper 6, thereby resulting in that the multicolored toner image is transferred onto the recording paper 6.

As has been described, the image forming apparatus 1 of the present embodiment carries out the transfer by contact, not by supplying the charges by air discharge as is the case with the conventional arrangement. As a result, the used voltage is low, the control of the voltage is easier, and a driving-use power is held down. In addition, compared with the conventional arrangement wherein charges are induced on the surface of the intermediate transfer drum 16 by air discharge so that the intermediate transfer drum 16 is charged, the arrangement of the present embodiment causes the surface of the intermediate transfer drum 16 to be stably charged, and hence causes the transfer to be stably carried out.

Furthermore, since the intermediate transfer drum 16 is charged by contact, the electric field region does not change even though the intermediate transfer drum 16 has a scar on its surface, and hence it by no means happens that the electric field balance is distorted at the scar on the surface of the intermediate transfer drum 16. Therefore, a transfer defect such as a white blank by no means occurs at an area corresponding to the scar, thereby ensuring the improvement of the transfer efficiency.

The following description will discuss the image forming process in the image forming apparatus 1.

As illustrated in FIG. 1, a monochromatic toner image of the first color is formed on the photosensitive drum 21. The monochromatic toner image of the first color is moved to the first transfer position X, with the rotation of the photosensitive drum 21. At the same time, a voltage having a polarity reverse to that of the toner is applied by the high voltage power supply 19*a* to the first transfer voltage applying roller 19, and the monochromatic toner image of the first color is transferred at the first transfer position X from the photosensitive drum 21 onto the intermediate transfer drum 16. Note that a process of charging, exposure, development, and transfer is carried out during one rotation of the photosensitive drum 21 with respect to each color. Therefore, a multicolored toner image is obtained, with four rotations of the intermediate transfer drum 16. Note that solely one rotation of the intermediate transfer drum 16 is required in the case where a monochrome toner image of a certain color, such as a black-and-white image, is to be obtained.

The first transfer voltage applying roller 19 is provided inside the intermediate transfer drum 16 so as to be in contact with the inner surface of the intermediate transfer drum 16, and so as to be movable in an arc with respect to the center of the intermediate transfer drum 16, being driven by driving means (not shown). So as to carry out the first transfers of the toner images of the four colors, the position of the first transfer voltage applying roller 19 changes in accordance with electric characteristics of the respective toners of the four colors. Distances of respective motions of the first transfer voltage applying roller 19 are determined so that the electric field generated at the first transfer position X, at which the intermediate transfer drum 16 and the photosensitive drum 21 come into contact, has strengths appropriate for transfer characteristics of the respective toners with respect to a voltage. With this arrangement, the respective toners can be transferred at a uniform transfer efficiency, without changing the transfer voltage. After all the monochromatic toner images are transferred onto the intermediate transfer drum 16, the multicolored toner image thus formed on the intermediate transfer drum 16 is moved to the second transfer position Y, with the rotation of the intermediate transfer drum 16.

On the other hand, in the case where the paper is automatically fed, during the image formation, sheets of the recording paper 6 are sequentially sent out one by one by the pickup roller 12 to the PF roller 13, from the top of the sheets of the recording paper 6 stored in the paper cassette 10 provided in the lowest part of the main body. The recording paper 6 passes the PF roller 13, and is transported by the register roller 15 to the second transfer position Y, at an image forming timing.

On the other hand, in the case where the recording paper 6 is fed by hand, sheets of the recording paper 6 are sent out one by one from the hand feeding unit 11 provided on the front of the main body, and are transported to the register roller 15 by the hand feeding roller 14. Then, the recording paper 6 is transported by the register roller 15 to the second transfer position Y at an image forming timing.

With the voltage having a polarity reverse to that of the toner being applied to the transfer roller 17, the multicolored toner image formed on the intermediate transfer drum 16 is transferred onto the recording paper 6 which has been transported to the second transfer position Y.

The recording paper 6 to which the second transfer has been carried out is transported to the transport guide 29 and the fixing guide 30, after being detached from the surface of the intermediate transfer drum 16 by the detaching pawl 18. The recording paper 6 is guided to the fixing roller 28 by the fixing guide 30, and the toner image is fixed on the recording paper 6 with the heat and pressure of the fixing roller 28. After the fixing of the toner image, the recording paper 6 is discharged into the discharge tray 32 by the discharge roller 31. In the case where the image formation is continued, the step of the first transfers and the step of the second transfer are repeated.

Figure 4:
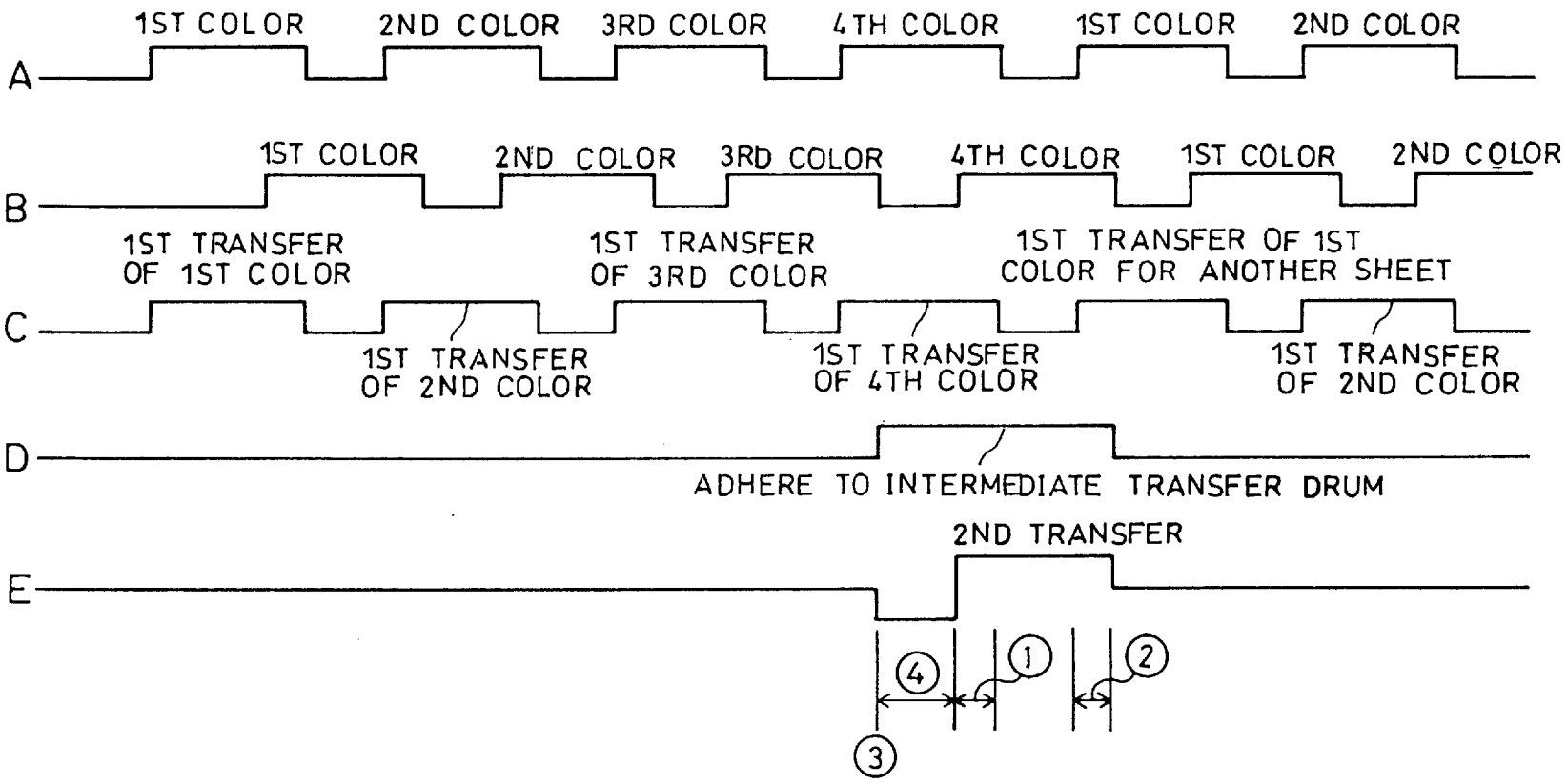
FIG. 4 is a timing chart illustrating timings for applying a first transfer voltage and a second transfer voltage in the case where a distance between a first transfer position and a second transfer position is smaller than a length of a sheet of recording paper.
Figure 5:
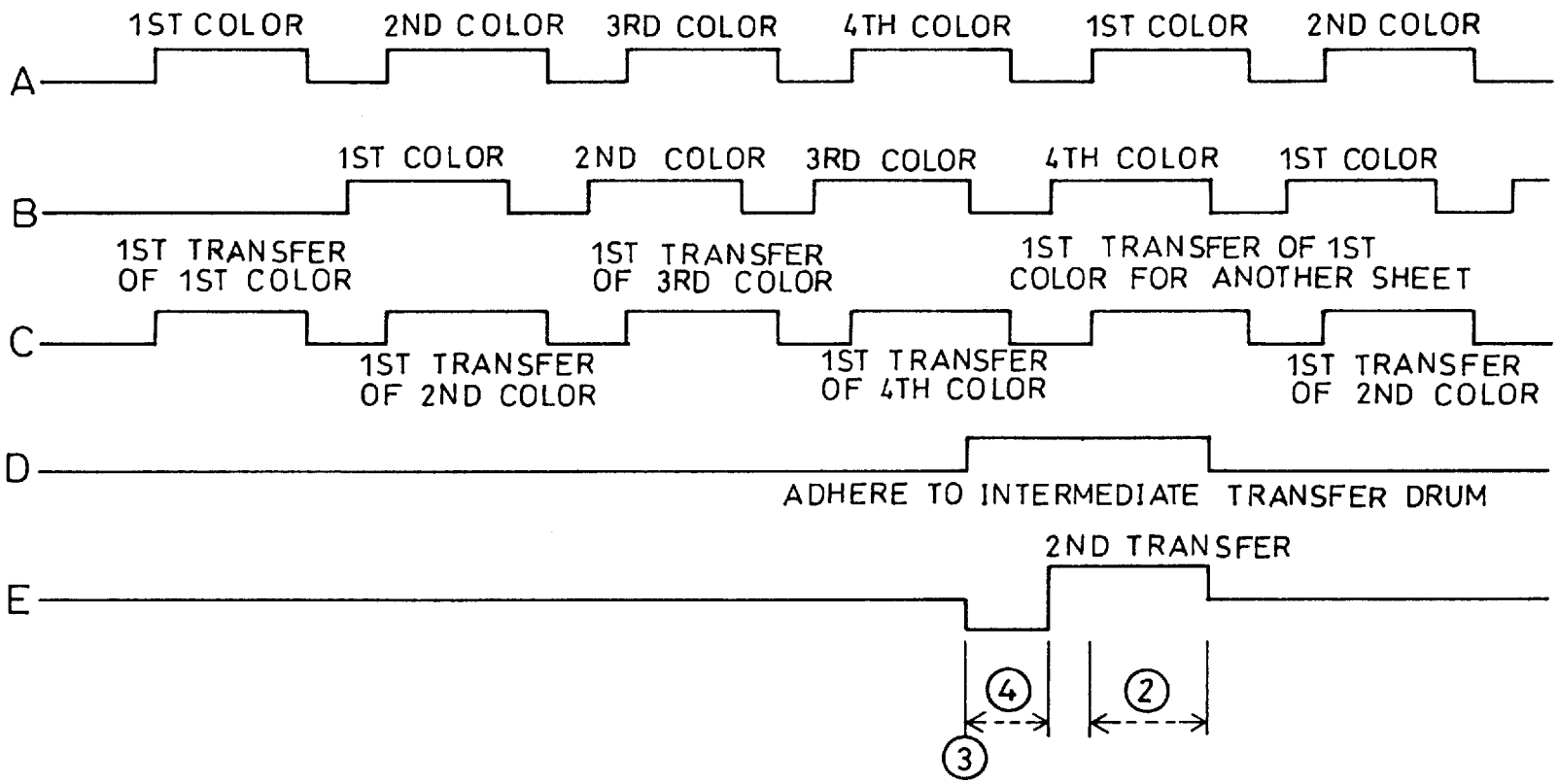
FIG. 5 is a timing chart illustrating timings for applying the first transfer voltage and the second transfer voltage in the case where the distance between the first transfer position and the second transfer position is not smaller than the length of a sheet of the recording paper.

The following description will discuss timings of the first transfer, the second transfer, and the cleaning of the transfer roller 17 in detail, while referring to FIGS. 4 and 5. Note that the distance from the first transfer position X to the second transfer position Y is given as Ls, and a length of the recording paper 6 is given as Lp.

In the figures, a square waveform A indicates timings at which the monochromatic toner images on the photosensitive drum 21 pass the first transfer position X. A square waveform B indicates timings at which the toner image on the intermediate transfer drum 16 passes the second transfer position Y. A square waveform C indicates timings at which a voltage is applied to the first transfer voltage applying roller 19. A square waveform D indicates timings at which the transfer roller 17 is pressed against the intermediate transfer drum 16. A square waveform E indicates timings at which a voltage is applied to the transfer roller 17.

Here, the following two timing charts can be thought of, depending on the relation between the distance Ls and the length Lp.

In the case where Ls<Lp, the second transfer of a multicolored toner image onto the recording paper 6 has already started before the final one of the first transfers of monochromatic toner images onto the intermediate transfer drum 16 is completed. In other words, there exists a period of time while the voltages are simultaneously applied at the first and second transfer positions X and Y, namely, a simultaneous voltage application period ①.

On the other hand, in the case where Ls≧Lp, the second transfer does not start before the first transfers finish, as illustrated in FIG. 5. Therefore, such a simultaneous voltage application period ① does not exist. But, in the case where each distance between the sheets of the recording paper 6 is shortened so as not to lower the copying speed during the continuous copying operation, the first transfer for the next image formation starts during the second transfer, irrelevant to the relation between the distance Ls and the length Lp. In this case, there exists a period of time while the respective voltages for the first and second transfers are simultaneously applied, namely, a simultaneous voltage application period ②.

In spite of the existence of the simultaneous voltage application periods ① and ②, however, it is possible in the image forming apparatus 1 of the present embodiment to smoothly carry out the transport of the recording paper 6 and to effectually carry out the image forming operation, since it is possible to individually apply respective voltages suitable for the first and second transfers. As a result, pictures of high quality can be obtained.

Note that as shown in FIGS. 4 and 5, the transfer roller 17 is pressed against the intermediate transfer drum 16 at a timing ③, that is, immediately after the a rear edge of the recording paper 6 on which the toner image of the third color was just transferred passes the second transfer position Y. Therefore, a period for cleaning the transfer roller 17, namely, a cleaning period ④, can be set as long as possible.

Figure 6:
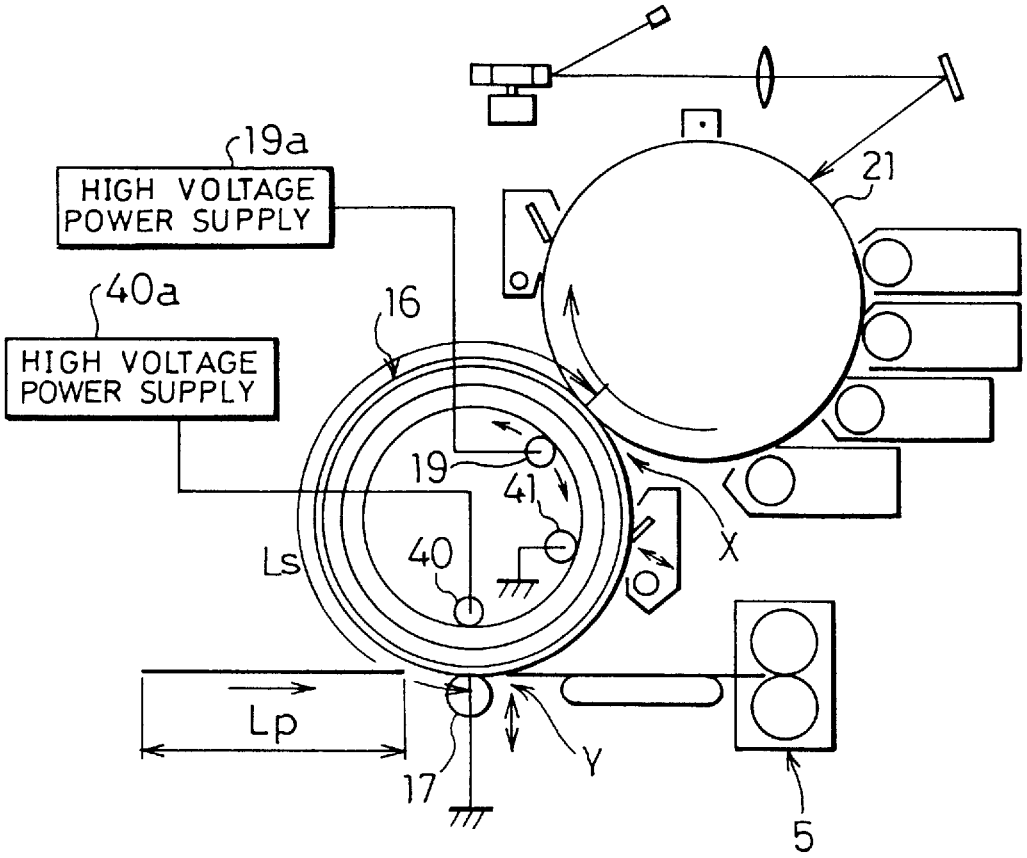
FIG. 6 is a cross-sectional view illustrating another arrangement of the image forming apparatus.

Incidentally, in the image forming apparatus 1, a second transfer voltage applying roller 40 connected with the high voltage power supply 40*a,* which is shown in FIG. 6, may be substituted for the second transfer grounded roller 20 shown in FIG. 3, and a second transfer voltage may be applied to the second transfer voltage applying roller 40 while the transfer roller 17 may be grounded. In this case, a grounded roller 41 (grounded electrode) is provided between the first transfer voltage applying roller 19 and the second transfer voltage applying roller 40, so as to eliminate mutual interference between the first and second transfers which is caused by applying respective voltages during the first and second transfers both from the inside of the intermediate transfer drum 16. Note that, as the first transfer voltage applying roller 19 and the second transfer grounded roller 20, the second transfer voltage applying roller 40 and the grounded roller 41 are covered with an elastic substance so as not to affect the rotation of the intermediate transfer drum 16.

During the second transfer, a voltage having the same polarity as that of the toner is applied to the second transfer applying roller 40, thereby causing the toner image formed on the intermediate transfer drum 16 to be transferred onto the recording paper 6.

By arranging so that the second transfer voltage is applied from inside the intermediate transfer drum 16, as described above, it is possible to arrange a single system so as to supply both the second transfer voltage and the first transfer voltage. With this arrangement, the structure of the voltage supplying system can be simplified. Furthermore, since there is no need to press and set apart the second transfer voltage applying roller 40 onto and from the intermediate transfer drum 16, stable application of the high voltage is enabled. Besides, since the second transfer voltage is applied from inside, it is possible to improve the transfer efficiency of toner particles underneath, which constituted monochromatic toner images which have been earlier transferred thereon.

[Second Embodiment]

Figure 7:
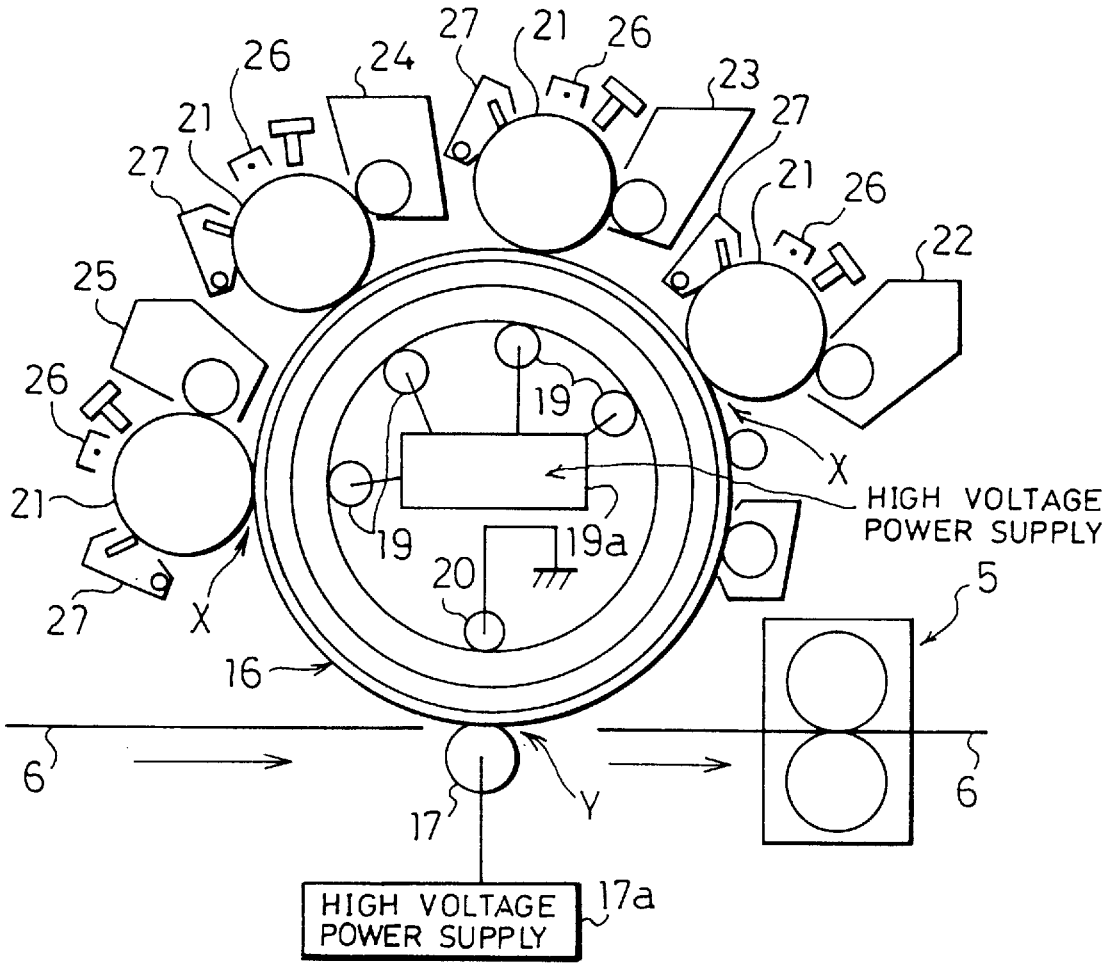
FIG. 7 is a cross-sectional view illustrating an arrangement of an image forming apparatus in accordance with another embodiment of the present invention.
Figure 8:
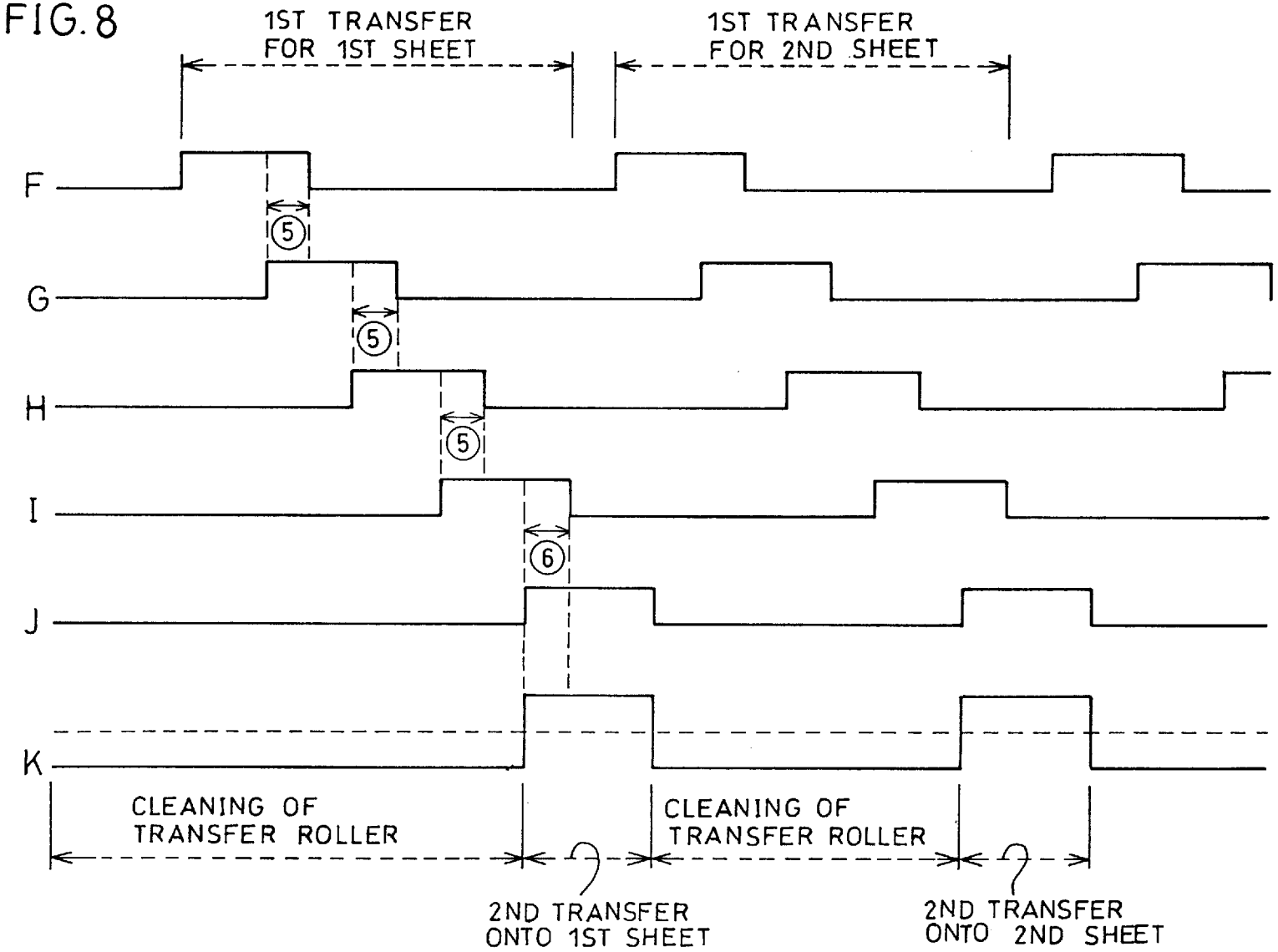
FIG. 8 is a timing chart illustrating timings for applying the first transfer voltage and the second transfer voltage in the case of the above image forming apparatus.

The following description will discuss another embodiment of the present invention, while referring to FIGS. 7 and 8. The members having the same structure (function) as those in the above-mentioned embodiment will be designated by the same reference numerals and their description will be omitted.

An image forming apparatus in accordance with the present embodiment has four photosensitive drums 21 around an intermediate transfer drum 16. The four photosensitive drums 21 form monochromatic toner images of four different colors, respectively. Around each photosensitive drum 21, a charger 26, exposure means (not shown), any one of developing units 22 through 25, and a cleaning unit 27 are provided. In addition, inside the intermediate transfer drum 16, there are provided first transfer voltage applying rollers 19 so as to be in contact with an inner surface of the intermediate transfer drum 16, each being provided so as to be opposite to each photosensitive drum 21. There are also grounded rollers (not shown) between each first transfer voltage applying roller 19, so as to eliminate mutual influences between the first transfers and the second transfer, which are caused by differences in voltages applied by the first transfer voltage applying rollers 19.

The following description will discuss the image forming process in the image forming apparatus having the above configuration.

First, each of the surfaces of the photosensitive drums 21 respectively corresponding to the development units 22 through 25 is uniformly charged by each charger 26, and is exposed by the exposure means. With this, latent images which are in accordance with signals corresponding to colors, respectively, are formed on the respective photosensitive drums 21.

The latent images formed on the photosensitive drums 21 are respectively developed by the developing units 22 through 25, thereby becoming monochromatic toner images having respective colors. On the application of transfer voltages onto the first transfer voltage applying rollers 19, the transfer voltages being respectively suitable for the colors, the monochromatic toner images developed are sequentially transferred onto the intermediate transfer drum 16 so that they overlap each other. After the last monochromatic toner image is transferred onto the intermediate transfer drum 16, a multicolored toner image thus formed on the intermediate transfer drum 16 is transported, with the rotation of the intermediate transfer drum 16, to the second transfer position Y between the intermediate transfer drum 16 and the transfer roller 17.

On the other hand, the recording paper 6 is sent out along the transport path simultaneously with the image formation described above. But, before it, using the second transfer grounded roller 20 as an opposite electrode, a voltage having a polarity reverse to that of the second transfer voltage, that is, a voltage having a negative polarity which is the same as that of the toner, is applied to the transfer roller 17 by the high voltage power supply 17*a*. With this, unnecessary toner particles adhering to the transfer roller 17 are caused to return to the intermediate transfer drum 16. Thus, unnecessary toner particles are removed from the transfer roller 17.

The polarity of the voltage applied to the transfer roller 17 is switched to the polarity reverse to that of the toner, and a positive voltage is applied to the transfer roller 17. This causes the multicolored toner image on the intermediate transfer drum 16 to be transferred onto the recording paper 6 which has been transported to the second transfer position Y. Thereafter, the recording paper 6 is detached from the intermediate transfer drum 16 by the detaching pawl 18 and is transported to the fixing unit 5, where the toner image is fixed on the recording paper 6.

Timings at which the first transfer, the second transfer, and the cleaning operation with respect to the transfer roller 17 are carried out will be described below, while referring to FIG. 8.

In FIG. 8, square waveforms F, G, H, and I respectively indicate timings at which toner images of yellow, magenta, cyanogen, and black are transferred onto the intermediate transfer drum 16 at the first transfer position X. A square waveform J indicates timings at which multicolored toner images pass the second transfer position Y. A square waveform K indicates respective timings at which the second transfer voltage and a voltage for cleaning the transfer roller 17 are applied.

In the case of the present embodiment, the first transfer positions X exist so that each position X corresponds to each color. In this case, it is unrealistic to set each distance between the first transfer positions X to a maximum length of the recording paper 6, since it may cause the intermediate transfer drum 16, and hence the image forming apparatus, to become bulkier.

Besides, in the case of the present embodiment, there exists a period of time while a plurality of the first transfer operations are simultaneously carried out, namely, a simultaneous voltage application period ⑤ while first transfer voltages are simultaneously applied. There also exists a period of time while the first transfer and the second transfer are simultaneous carried out, namely, a simultaneous voltage application period ⑥ while the first and second transfer voltages are simultaneously applied. However, in spite of these simultaneous voltage application periods ⑤ and ⑥, appropriate voltages can be respectively applied in the image forming apparatus of the present embodiment. Therefore, it is possible to smoothly transport the recording paper 6, as is the case with the first embodiment. As a result, a multicolor copy can be carried out at a speed substantially equal to that of a monochromatic copy, while pictures of high quality can be obtained due to effectual image forming operations.

Furthermore, since there is no need to press and set apart the transfer roller 17 onto and from the intermediate transfer drum 16, the cleaning of the transfer roller 17 can be carried out solely by applying a voltage having a polarity reverse to the second transfer voltage, except while the second transfer is carried out, as indicated by the square waveform K in the figure.

Note that in each of the image forming apparatuses of the above first and second embodiments, the conductive rollers are provided inside and/or outside the intermediate transfer drum 16, so as to apply voltages to the intermediate transfer drum 16 or so as to ground the intermediate transfer drum 16, but anything conductive, such as conductive brushes, may be substituted for the conductive rollers.

[Third Embodiment]

The following description will discuss an embodiment of the present invention, while referring to FIGS. 9 through 15. An image forming apparatus wherein a toner image is directly transferred from a photoconductive drum onto recording paper will be described below as an apparatus in accordance with the present embodiment. The members having the same structure (function) as those in the above-mentioned first and second embodiments will be designated by the same reference numerals and their description will be omitted.

Figure 9:
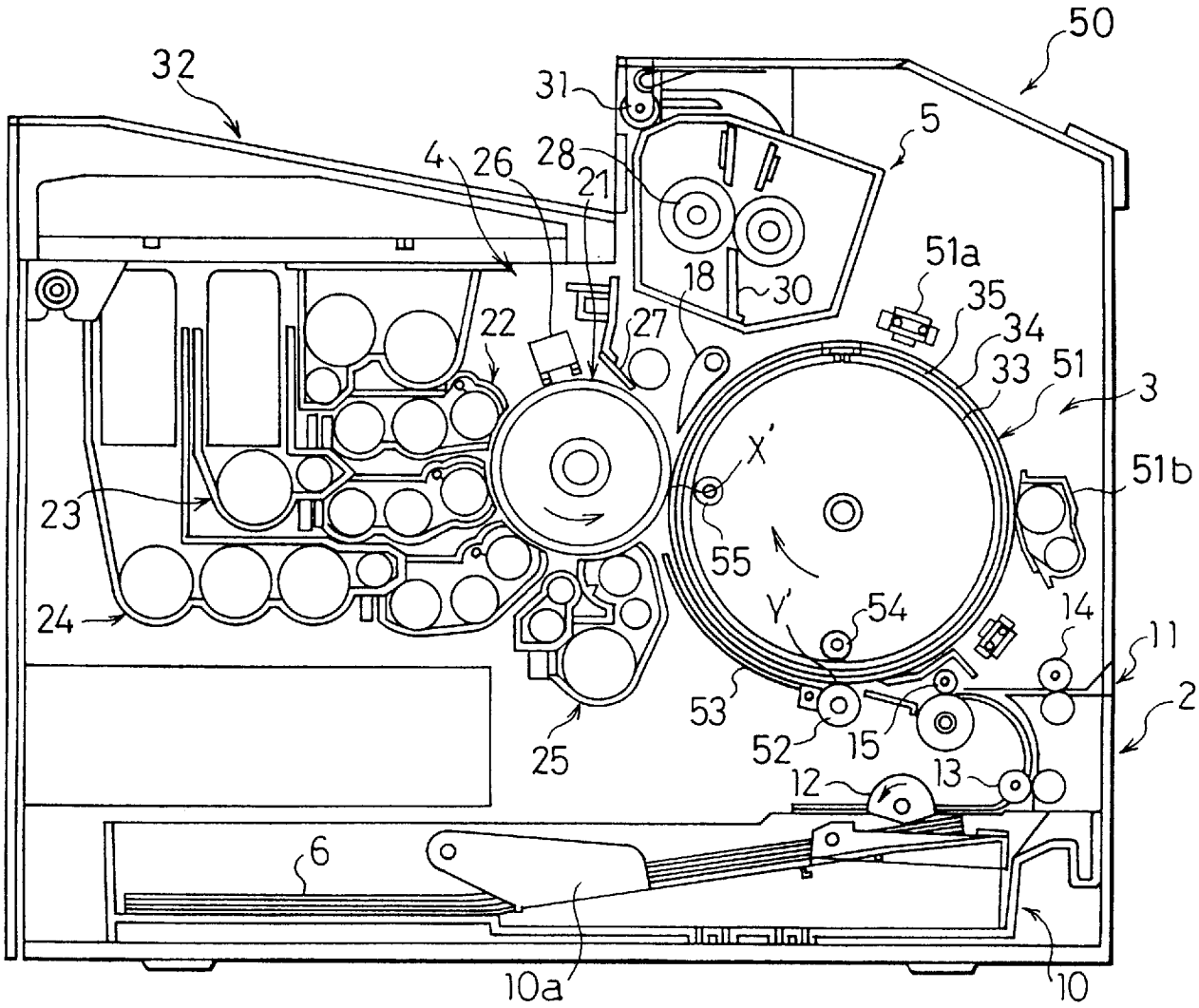
FIG. 9 is a cross-sectional view illustrating an arrangement of an image forming apparatus in accordance with still another embodiment of the present invention.

An image forming apparatus 50 of the present embodiment has a paper feed unit 2, a transfer unit 3, a development unit 4, and a fixing unit 5, as illustrated in FIG. 9. The paper feed unit 2 stores sheets of the recording paper 6 (recording medium) onto which toner images are transferred, while feeds the recording paper 6 to the transfer unit 3. The transfer unit 3 transfers the toner image which is formed on a photosensitive drum 21 (described later) onto recording paper 6. The development unit 4 forms the toner image in accordance with a latent image which is formed on the photosensitive drum 21 with projection of a laser beam. The fixing unit 5 fixes the toner image transferred onto the recording paper 6 by fusing toner particles thereon.

Note that a position at which the toner image formed on the photoconductive drum 21 is transferred onto the recording paper 6 on a transfer drum 51 (described later) is hereinafter referred to as a transfer position X', while a position at which the recording paper 6 is adsorbed to the transfer drum 51 between the transfer drum 51 and an adsorption roller 52 (described later) is hereinafter referred to as a adsorption position Y'.

The following description will discuss an arrangement of the image forming apparatus 50 in detail, while referring to FIG. 9.

The paper feed unit 2 includes a paper cassette 10 and a hand feeding unit 11. The paper cassette 10 is removably provided in the lowest part of the image forming apparatus 50. Sheets of the recording paper 6 stored in the paper cassette 10 are supplied therefrom to the transfer unit 3. The hand feeding unit 11 is provided on a front of the image forming apparatus 50. To the hand feeding unit 11, sheets of the recording paper 6 are supplied by hand one by one.

There are provided a pickup roller 12, a pre-feed roller (hereinafter referred to as PF roller) 13, a hand feeding roller 14, and a register roller 15, between the paper feed unit 2 and the transfer unit 3.

The pickup roller 12 sends out sheets of the recording paper 6 from the top of the sheets in the paper cassette 10 one by one. The PF roller 13 transports the recording paper 6 sent out by the pickup roller 12 to the register roller 15. The hand feeding roller 14 transports the recording paper 6 supplied from the hand feeding unit 11 to the register roller 15. The register roller 15 temporarily stops the recording paper 6 transported by the PF roller 13 or the hand feeding roller 14 just before the transfer unit 3, so that the recording paper 6 is transported to the transfer unit 3 at a predetermined timing.

The paper cassette 10 includes a push-up member 10*a* on which the recording paper 6 is placed, the push-up member having a spring or the like so that the recording paper 6 placed thereon is pushed up. A sheet on the top of the sheets of the recording paper 6 accumulated in the paper cassette 10 is pressed against the pickup roller 12, being pushed up by the push-up member 10*a*. The sheets of the recording paper 6 are sent out one by one to the PF roller 13, with the rotation of the pickup roller 12 in a direction indicated by an arrow in the figure, and then, each of the sheets is transported to the register roller 15. On the other hand, in the case where the recording paper 6 is supplied from the hand feeding unit 11, the recording paper 6 is transported by the hand feeding roller 14 to the register roller 15.

The transfer unit 3 has the transfer drum 51 (transfer medium), the adsorption roller 52 (pressing means), a guiding member 53, and a detaching pawl 18. The adsorption roller 52, the guiding member 53, and the detaching pawl 18 are provided around the transfer drum 51. The recording paper 6 is adsorbed to the transfer drum 51, and toner images formed on the photosensitive drum 21 are transferred onto the recording paper 6. The adsorption roller 52 presses the recording paper 6 against the transfer drum 51, while applies a voltage from a high voltage power supply 52*a* (described later) to the transfer drum 51. The adsorption roller 52 causes the recording paper 6 to be adsorbed to the transfer drum 51. The guiding member 53 guides the recording paper 6 so that the recording paper 6 does not come off the transfer drum 51. The detaching pawl 18 detaches the recording paper 6 from the transfer drum 51. Note that the detaching pawl 18 is provided so as to flexibly be made in contact with and be set apart from a surface of the transfer drum 51.

Inside the transfer drum 51, there are provided a transfer voltage applying roller 55 (first electrode) and an adsorption grounded roller 54 (second electrode) at a position opposite to the photosensitive drum 21 and at a position opposite to the adsorption roller 52, respectively, so as to he in contact with an inner surface of the transfer drum 51. The transfer voltage applying roller 55 applies a transfer voltage to the transfer drum 51 at the transfer position X'. The adsorption grounded roller 54 is grounded at the adsorption position Y'.

Surfaces of the transfer voltage applying roller 55 and the adsorption grounded roller 54 are covered with an elastic substance, for example, urethane rubber, or silicon. Therefore, neither the transfer voltage applying roller 54 nor the adsorption roller 54 causes vibration which may affect the transfer drum 51. As a result, the transfer voltage applying roller 55 and the adsorption grounded roller 54 are stably in contact with the transfer drum 51, and hence it is possible to stably rotate the transfer drum 51.

It is also arranged that the toner images are transferred onto the surface of the transfer drum 51 with static electricity. Therefore, there are further provided a charge removing unit 51*a*, a cleaning unit 51*b*, or the like, around the transfer drum 51. The charge removing unit 51*a* removes charges remaining on the surface of the transfer drum 51. The cleaning unit 51*b* removes toner particles or the like adhering to the surface of the transfer drum 51.

On each end of an axis of the transfer drum 51, there is provided a flange made of insulating material. The transfer drum 51 is installed in a main body flame by the intermediation of bearings provided on the flanges. Being thus arranged, the transfer drum 51 is rotatably fixed to the main body flame while it is insulated from the main body flame. Therefore, electric influences from other devices are shut out, while the surface of the transfer drum 51 is electrically stabilized.

Note that the transfer drum 51 has the same detailed structure as that of the intermediate transfer drum 16 depicted in the descriptions of the first and second embodiments. Therefore, description of the detailed structure of the transfer drum 51 is omitted here.

In the development unit 4, the photosensitive drum 21 which is pressed by the transfer drum 51 at the transfer position X' is rotatably provided. The photosensitive drum 21 is composed of an aluminum tube whose outer surface is covered with OPC (organic photoconductive conductor) film. This aluminum tube is grounded.

Around the photosensitive drum 21, developing elements 22, 23, 24, and 25, a charger 26, a cleaning unit 27, and an image space eraser (not shown) are radially provided. The developing elements 22, 23, 24, and 25 contain toners of yellow, magenta, cyanogen, and black, respectively. The charger 26 charges the surface of the photosensitive drum 21. The cleaning unit 27 removes toner particles remaining on the surface of the photosensitive drum 21.

For each color, each monochromatic toner image is individually formed on the photosensitive drum 21. In other words, for each color, charging, exposure, development and transfer are carried out. Therefore, a monochromatic toner image of one color on the photosensitive drum 21 is transferred onto the recording paper 6 adsorbed to the transfer drum 51 during one rotation of the transfer drum 51, and hence a multicolored toner image is obtained on the recording paper 6 after four times of rotation of the transfer drum 51.

Note that the exposure of the surface of the photosensitive drum 21 is carried out with projection of a light beam onto a surface of the photosensitive drum 21, for example, by projecting a laser beam on an area between the charger 26 and the developing element 22.

The fixing unit 5 has a fixing roller 28 and a fixing guide 30. The fixing roller 28 fuses toner particles at a predetermined temperature with a predetermined pressure, so that the toner image is fixed onto the recording paper 6. The fixing guide 30 guides, toward the fixing roller 28, the recording paper 6 which was detached from the transfer drum 51 by the detaching pawl 18 after the transfer of the toner image. In the fixing unit 5, there are provided a discharge roller 31 and a discharge tray 32 on a side to a downstream of the direction of transport of the recording paper 6, so that after fixing operations the recording paper 6 is discharged to the discharge tray 32 and held therein.

The following description will discuss a structure of the adsorption roller 52. Note that the adsorption roller 52 has the following configuration in the case where negatively polarized toner is utilized, but the same theory as that described below is applicable in the case where positively polarized toner is utilized.

Figure 10:
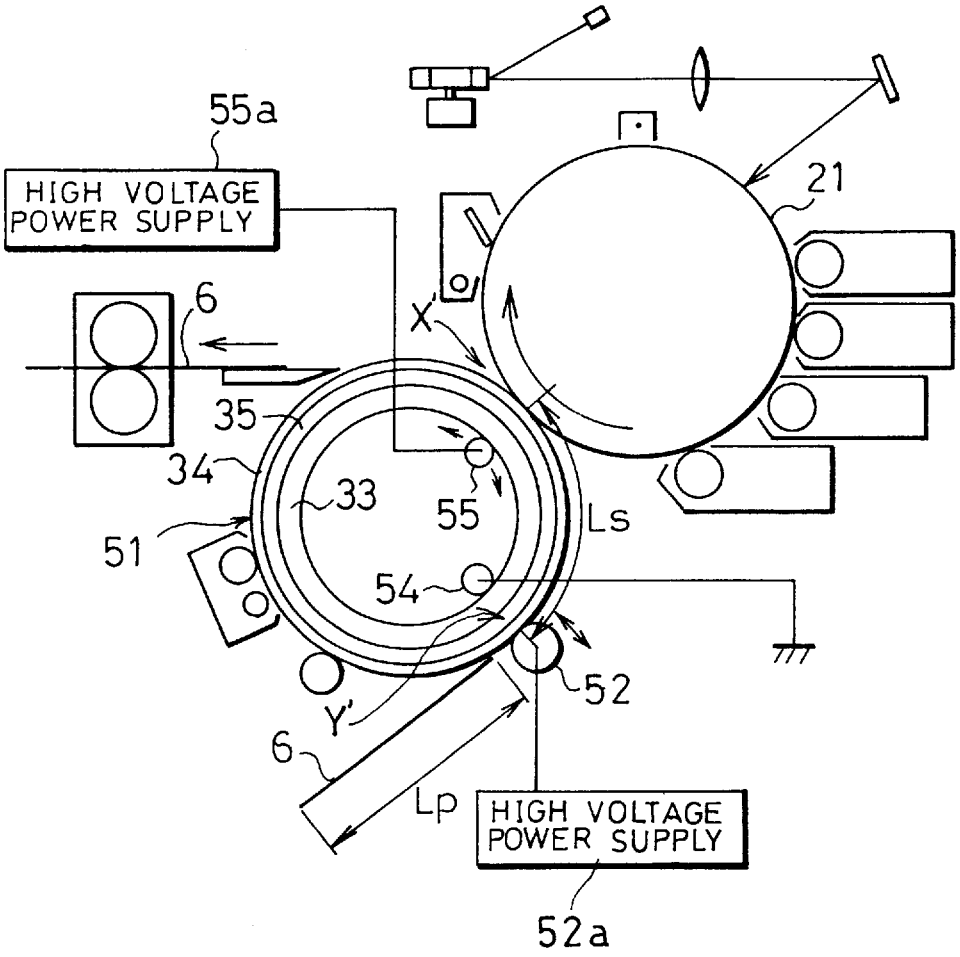
FIG. 10 is a cross-sectional view illustrating principal parts of the above image forming apparatus.

The adsorption roller 52 provided below the transfer drum 51 is connected to the high voltage power supply 52*a,* as illustrated in FIG. 10. The high voltage power supply 52*a* supplies a voltage having the same polarity as that of the toner, i.e., a negative voltage, to the adsorption roller 52. With this arrangement, when the recording paper 6 passes the adsorption position Y' between the adsorption roller 52 and the transfer drum 51, the recording paper 6 is electrostatically adsorbed to the transfer drum 51.

Note that in the present embodiment, it is possible to switch the polarity of the voltage applied to the adsorption roller 52 at any time. When the adsorption roller 52 is continuously used for a long period of time, it sometimes occurs that a surface of the recording paper 6 is soiled due to unnecessary toner particles adhering to the surface of the adsorption roller 52, thereby resulting in that an adequate picture cannot be obtained. This problem is solved by causing the adsorption roller 52 to come into contact with the transfer drum 51 when the recording paper 6 is not passing the adsorption position Y', and applying a voltage having the same polarity of that of the toner. By doing this, unnecessary toner particles adhering to the adsorption roller 52 are caused to move to the transfer drum 51, and the adsorption roller 52 is cleaned. The unnecessary toner particles which have moved onto the transfer drum 51 are collected by the cleaning unit 51*b*. Therefore, with the above-described arrangement wherein unnecessary toner particles adhering to the surface of the adsorption roller 52 can be removed, it is avoidable that the surface of the recording paper 6 is soiled, even in the case where the adsorption roller 52 is continuously used for a long period of time.

The cleaning of the adsorption roller 52 is carried out by pressing the adsorption roller 52 against the transfer drum 51, immediately after a rear edge of a sheet of the recording paper 6, on which the monochromatic toner image of the third color was just transferred so as to overlap a resultant toner image of the two colors previously transferred thereon, passes the adsorption position Y'. By doing this, it is enabled to allot a longer period of time to the cleaning operation. The action of pressing the adsorption roller 52 against the transfer drum 51 during the cleaning operation does not differ from an action of causing a next sheet of the recording paper 6 to be adsorbed to the transfer drum 51 during a continuous copying operation. Therefore, variations of the motions of the transfer roller 52 are not increased.

The hardness of the surface of the adsorption roller 52 is set smaller than that of the elastic layer 35 of the transfer drum 51. With this arrangement, the adsorption roller 52 deforms when the recording paper 6 passes the adsorption position Y' so that the recording paper 6 curves along the transfer drum 51, thereby increasing a nip width. As a result, a longer adsorption period can be obtained and the adsorptivity is enhanced.

During the image formation, it sometimes occurs that the toner image formed on the recording paper 6 due to electrostatic adhesion of the toner particles thereto is distorted when the recording paper 6 which have been adsorbed to the transfer drum 51 and transported with the rotation of the transfer drum 51 comes in contact with the adsorption roller 52 and is pressed by the adsorption roller 52. To avoid this problem, there are provided, for example, solenoids (not shown) as driving means at each end of the rotation axis of the adsorption roller 52 in the apparatus of the present embodiment, so that the adsorption roller 52 is mechanically pressed against and set apart from the intermediate transfer drum. With this arrangement, the adsorption roller 52 is allowed to have a stable nip width at the adsorption position Y'. On the other hand, while the operation of adsorbing the recording paper 6 is not carried out, the adsorption roller 52 is kept a predetermined distance apart from the transfer drum 51.

Figure 11:
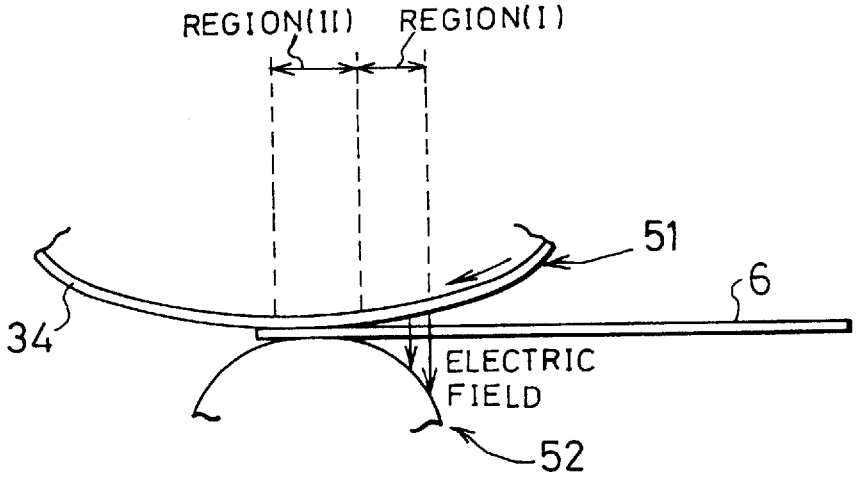
FIG. 11 is a cross-sectional view illustrating a region where a transfer drum and an adsorption roller come into contact.

The following description will discuss a process of adsorbing the recording paper 6 to the transfer drum 51, and a process of transferring toner images on the photosensitive drum 21 onto the recording paper, while referring to FIGS. 10 and 11.

When the recording paper 6 is transported to the adsorption position Y' between the adsorption roller 52 and the transfer drum 51, the recording paper 6 is pressed against a surface of an insulating layer 34 of the transfer drum 51 by the adsorption roller 52. Here, the recording paper 6 curves along the transfer drum 51. At the same time, the recording paper is adsorbed to the transfer drum 51, due to Paschen discharge and injection of charges.

To be more specific, with the application of a negative adsorption voltage to the adsorption roller 52, positive charges are induced on the surface of the insulating layer 34. With this, an electric field is generated there in a direction from the transfer drum 51 to the adsorption roller 52, as illustrated in FIG. 11. In a region (I) where the insulating layer 34 and the adsorption roller 52 are very close to each other, air dielectric breakdown comes to happen as the electric field becomes stronger. As a result, the so-called Paschen discharge occurs between the transfer drum 51 and the adsorption roller 52.

After the discharge finished, injection of charges from the adsorption roller 52 to the transfer drum 51 occurs in a region (II) in the figure, thereby causing positive charges to be accumulated on the surface of the transfer drum 51. In other words, with the Paschen discharge and the injection of charges, positive charges are accumulated on a surface of the recording paper 6, the surface being in contact with the insulating layer 34. As a result, the recording paper 6 is electrostatically adsorbed to the transfer drum 51. The recording paper 6 thus adsorbed to the transfer drum 51 is transported to the transfer position X' at which the transfer drum 51 and the photosensitive drum 21 come into contact, with a rotation of the transfer drum 51 in a direction indicated by an arrow in the figure.

On the other hand, on the surface of the photosensitive drum 21, a toner image is formed with negatively polarized toner. When the recording paper 6 passes the transfer position X', a voltage having a polarity reverse to that of the toner, that is, a positive voltage, is applied to the transfer voltage applying roller 55, by a high voltage power supply 55*a* shown in FIG. 10. As a result, an electric field is formed at the transfer position X' in a direction from the transfer drum 51 to the photosensitive drum 21, and the electric field causes the toner image formed with the negatively polarized toner to be transferred onto the recording paper 6 on the transfer drum 51.

Note that the transfer drum 51 is pressed against the photosensitive drum 21 at the transfer position X' so as to have a predetermined nip width.

As has been described, the image forming apparatus 50 of the present embodiment carries out the transfer by contact, not by supplying the charges by air discharge as is the case with the conventional arrangement. As a result, the used voltage is low, the control of the voltage is easier, and a driving-use power is held down. In addition, compared with the conventional arrangement wherein charges are induced on the surface of the transfer drum 51 by air discharge so that the transfer drum 51 is charged, the arrangement of the present embodiment causes the surface of the transfer drum 51 to be stably charged, and hence ensures that the transfer is stably carried out.

Furthermore, since the transfer drum 51 is charged by contact, the electric field region does not change even though the transfer drum 51 has a scar on its surface, and hence it by no means happens that the electric field balance is distorted at the scar on the surface of the transfer drum 51. Therefore, it by no means occurs that a transfer defect such as a white blank is caused at an area corresponding to the scar, thereby ensuring the improvement of the transfer efficiency. The following description will discuss re-adsorption of the recording paper 6 to the transfer drum 51.

In the case the recording paper 6 is thick, the recording paper 6 may not be adequately adsorbed to the transfer drum 51, depending on flexural rigidity of the recording paper 6. In this case, the recording paper 6 likely comes off from the transfer drum 51, and a transfer failure possibly happens. Therefore, so as to achieve stable adsorptivity, a fore edge part (non-image area) of a sheet of the recording paper 6 is re-adsorbed to the transfer drum 51, before every transfer action except the transfer of the first color toner image.

To be more specific, during the multicolor image formation, the recording paper 6, being adsorbed to the transfer drum 51, rotates at least twice. Therefore, after the monochromatic toner image of the first color is transferred onto the recording paper 6, and before the recording paper 6 passes the adsorption position Y' again, the adsorption roller 52 is pressed against the transfer drum 51 so that the fore edge part of the recording paper 6 is adhered to the transfer drum 51. Simultaneously, the adsorption voltage is applied to the transfer drum 51, so that only the fore edge part of the recording paper 6 is adsorbed to the transfer drum 51. By thus carrying out the re-adsorption, it is avoidable that an image formed on the recording paper 6 is out of a right position, thereby resulting in that clear images can be obtained.

It is preferable that as the above case, the rear edge part (non-image area) of the recording paper 6 is re-adsorbed to the transfer drum 51, since superior and stable adsorptivity will be achieved.

The following description will discuss an image forming process in the image forming apparatus 50 arranged as above.

In the case where the paper is automatically fed, during the image formation, sheets of the recording paper 6 are sequentially sent out one by one to the PF roller 13 by the pickup roller 12, from the top of the sheets of the recording paper 6 stored in the paper cassette 10 provided in the lowest part of the main body, as illustrated in FIG. 9. The recording paper 6 passes the PF roller 13, and is transported by the register roller 15 to the adsorption position Y', at an image forming timing. On the other hand, in the case where the recording paper 6 is fed by hand, sheets of the recording paper 6 are sent out one by one from the hand feeding unit 11 provided on the front of the main body, and are transported to the register roller 15 by the hand feeding roller 14. Then, the recording paper 6 is transported by the register roller 15 to the adsorption position Y' at an image forming timing.

At the adsorption position Y', the recording paper 6 is charged due to the voltage applied to the adsorption roller 52. Also, charges are induced in the insulating layer 34 through the recording paper 6, thereby causing the recording paper 6 to be electrostatically adsorbed to the transfer drum 51.

Thereafter, the recording paper 6 adsorbed to the transfer drum 51 is transported to the transfer position X' at which the transfer drum 51 and the photosensitive drum 21 come into contact. Here, a voltage having a polarity reverse to that of the toner is applied to the transfer voltage applying roller 55. As a result, the toner image is transferred onto the recording paper 6 due to a potential difference between charges of the toner on the photosensitive drum 21 and the charges on the surface of the recording paper 6.

For each color, charging, exposure, development, and transfer are carried out with respect to the photosensitive drum 21. Therefore, the recording paper 6, kept adsorbed to the transfer drum 51, rotates with the rotation of the transfer drum 51. Therefore, a monochromatic toner image is transferred onto the recording paper 6 during one rotation of the transfer drum 51, and hence a multicolored toner image is obtained after at most four rotations of the transfer drum 51. Note that solely one rotation of the photosensitive drum 16 is required in the case where a monochrome toner image of a certain color, such as a black-and-white image, is to be obtained.

The transfer voltage applying roller 55 is provided inside the transfer drum 51 so as to be in contact with the inner surface of the transfer drum 51 and so as to be movable in an arc with respect to the center of the transfer drum 51 (as indicated by an arrow in the figure), being driven by driving means (not shown). Thus, the position of the transfer voltage applying roller 55 changes in accordance with electric characteristics of the respective monochromatic toners, so as to carry out the transfers. Distances of respective motions of the transfer voltage applying roller 55 are determined so that the electric field generated at the transfer position X', at which the transfer drum 51 and the photosensitive drum 21 come into contact, has strengths appropriate for transfer characteristics of the respective toners with respect to the voltage applied. With this arrangement, the respective toners can be transferred at a uniform transfer efficiency, without changing the transfer voltage applied to the transfer voltage applying roller 55.

After finishing the transfer of all the monochromatic toner images onto the recording paper 6, the recording paper 6 is detached from the surface of the transfer drum 51 by the detaching pawl 18 which is provided so as to flexibly be made in contact with and be set apart from the surface of the transfer drum 51. Then, the recording paper 6 is transported to the fixing guide 30, and guided to the fixing roller 28 by the fixing guide 30. The multicolored toner image formed on the recording paper 6 is fused and fixed thereon at a predetermined temperature with a predetermined pressure given by the fixing roller 28. After the fixation, the recording paper 6 is discharged by the discharge roller 31 to the discharge tray 32.

The following description will discuss in detail the timings of the adsorption of the recording paper 6 to the transfer drum 51, the transfer of toner images onto the recording paper 6, and the cleaning of the adsorption roller 52, while referring to FIGS. 10 and 12 through 15.

In FIGS. 12 through 15, a square waveform L indicates timings at which the adsorption roller 52 is made in contact with and is set apart from the transfer drum 51. A square waveform M indicates timings at which the adsorption voltage is applied. A square waveform U indicates timings at which the transfer voltage is applied. Square waveforms N and T indicate whether or not the recording paper 6 is present at the adsorption position Y' and at the transfer position X', respectively. In the figures, periods in the ON states represent periods while the adsorption roller 52 is in contact with the transfer drum 51, while the adsorption voltage is applied, while the transfer voltage is applied, while the recording paper 6 passes the adsorption position Y', and while the recording paper 6 passes the transfer position X', respectively.

Here, in the case where a distance from the transfer position X' to the adsorption position Y' is given as Ls and a length of the recording paper 6 is given as Lp, as illustrated in FIG. 10, the following two timing charts can be thought of, depending on the relation between the distance Ls and the length Lp.

Figure 12:
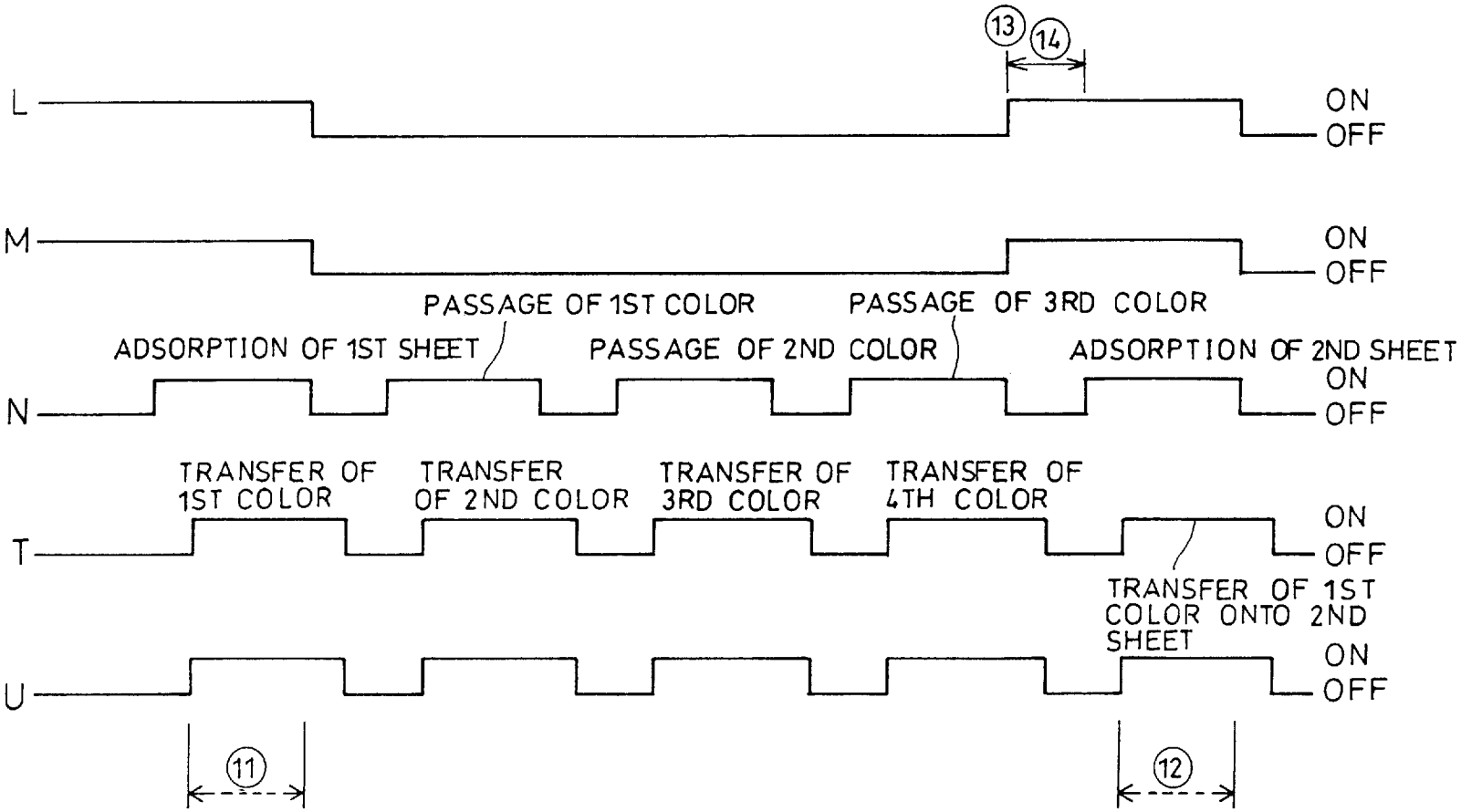
FIG. 12 is a timing chart illustrating timings for applying an adsorption voltage and a transfer voltage in the image forming apparatus, in the case where a distance between an adsorption position and a transfer position is smaller than the length of a sheet of the recording paper.

In the case where Ls<Lp, a timing chart shown in FIG. 12 is obtained. In this case, before a rear edge of the recording paper 6 passes the adsorption position Y', a fore edge of the recording paper 6 passes the transfer position X' and the transfer starts. Therefore, there exists a period of time while application of a voltage at the transfer position X' and that at the adsorption position Y' are simultaneously carried out, namely, a simultaneous voltage application period (11).

Figure 13:
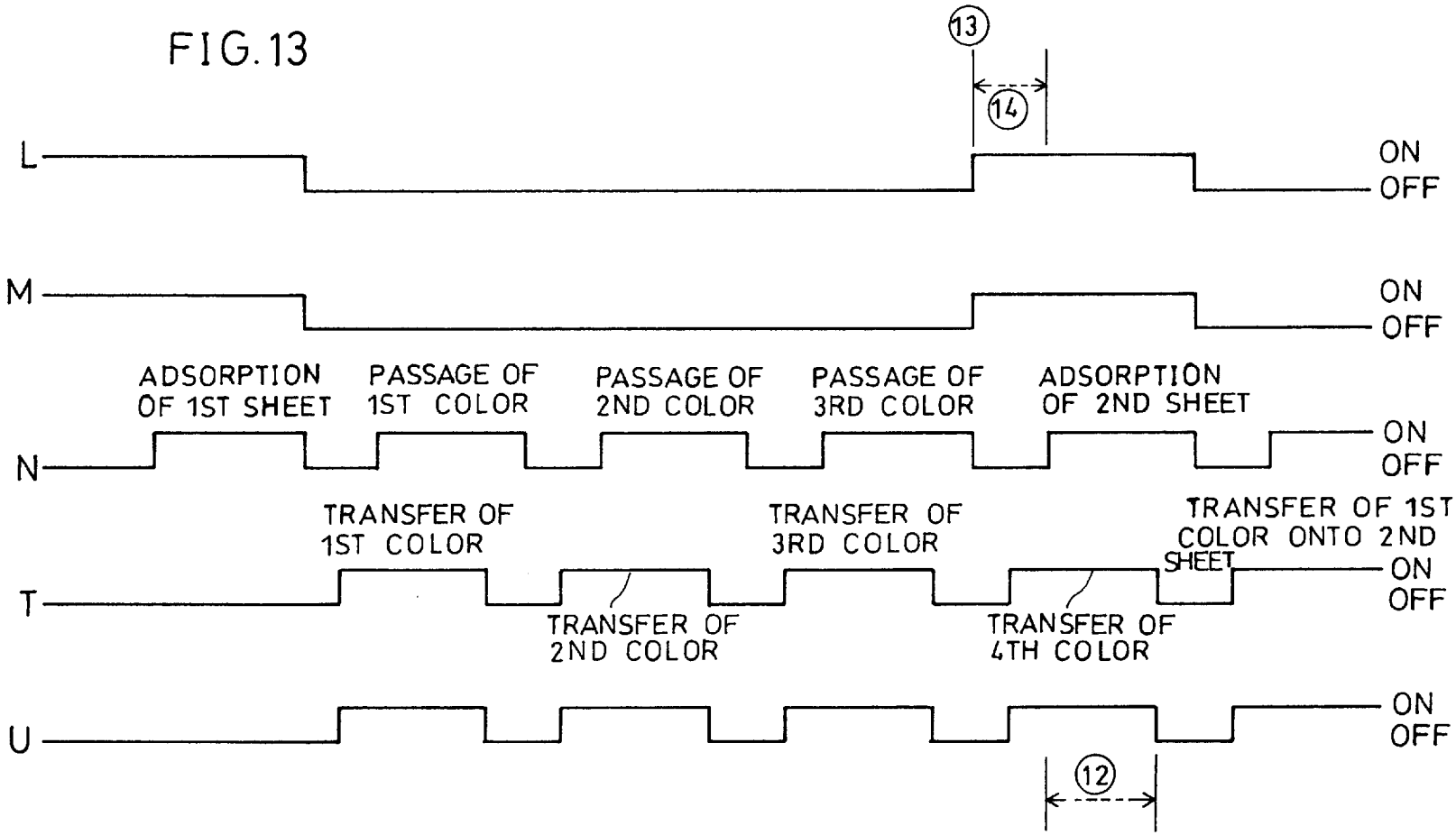
FIG. 13 is a timing chart illustrating timings for applying the adsorption voltage and the transfer voltage in the image forming apparatus, in the case where the distance between the adsorption position and the transfer position is not smaller than the length of a sheet of the recording paper.

On the other hand, in the case where Ls≧Lp, the transfer does not start before the adsorption of the recording paper 6 to the transfer drum 51 completely finishes, as illustrated in FIG. 13. Therefore, such a simultaneous voltage application period (11) does not exist.

In the case where each distance between the sheets of the recording paper 6 is shortened so as not to lower the copying speed during the continuous copying operation, the adsorption of the next sheet of the recording paper 6 starts before the transfer of the last monochromatic toner image completely finishes, irrelevant to the relation between the distance Ls and the length Lp. In this case, there exists a period of time while the application of the adsorption voltage and the application of the transfer voltage are simultaneously carried out, namely, a simultaneous voltage application period (12).

In spite of the existence of the simultaneous voltage application periods (11) and (12), however, it is possible in the image forming apparatus of the present embodiment to individually apply respective voltages suitable for the adsorption and the transfer. Therefore, it is possible to smoothly transport the recording paper 6 and to effectually carry out the image forming operation, thereby resulting in that pictures of high quality can be obtained.

Note that as shown in FIGS. 12 and 13, the adsorption roller 52 is pressed against the transfer drum 51 at a timing (13), that is, immediately after the a rear edge of the recording paper 6, on which the monochromatic toner image of the third color was just transferred, passes the adsorption position Y'. Therefore, a period for cleaning the adsorption roller 52, namely, a cleaning period (14) can be set as long as possible.

Figure 15:
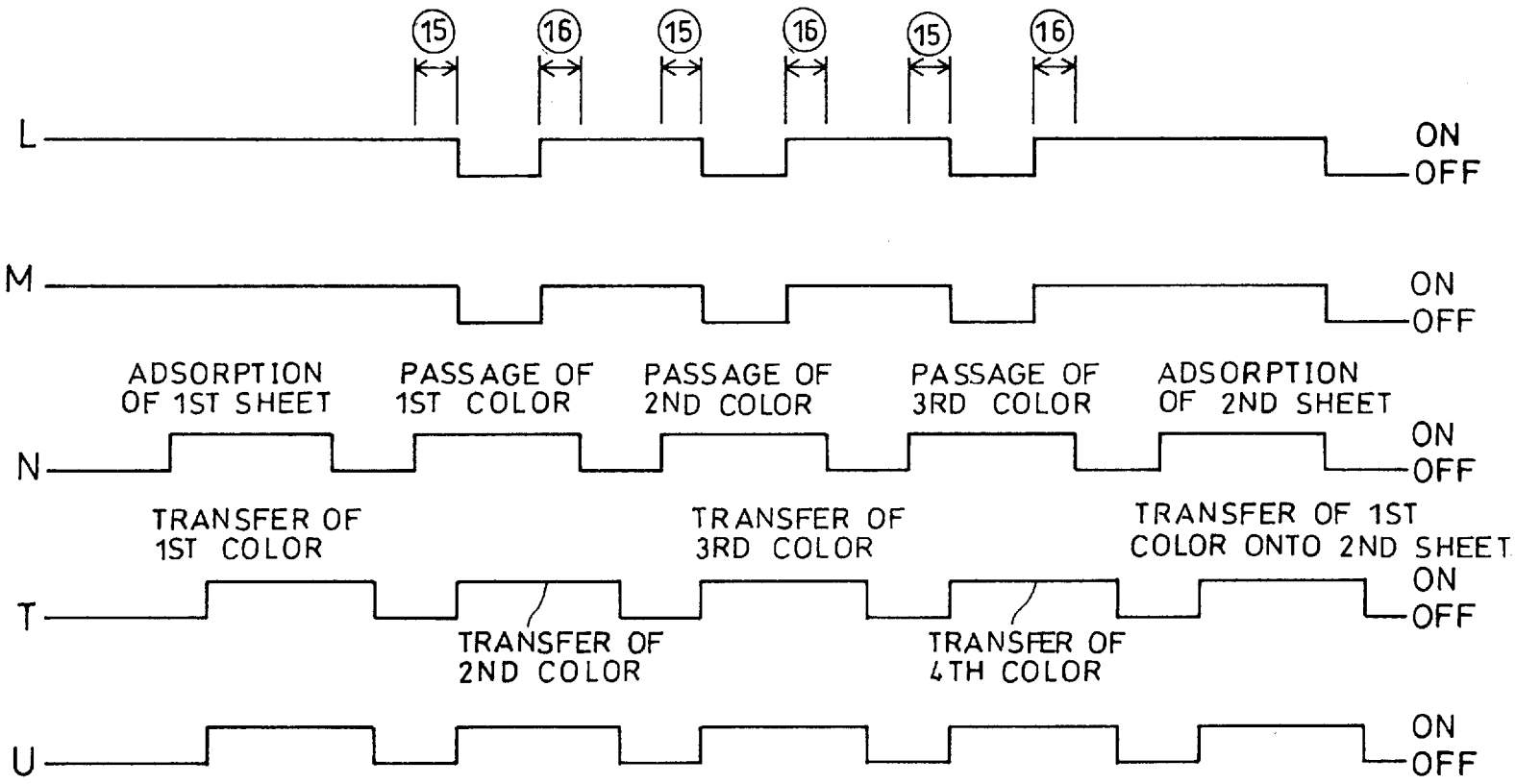
FIG. 15 is a timing chart illustrating the timings of re-adsorption, in the case where both the fore edge part and a rear edge part of the recording paper are re-adsorbed.

In the case where the adsorption roller 52 is pressed against the transfer drum 51 when the rear edge part of the recording paper 6 adsorbed to the transfer drum 51 passes the adsorption position Y' so that only the fore edge part (non-image area) of the recording paper 6 are re-adsorbed, re-adsorption periods (15) is caused as illustrated in FIG. 15.

In the case where the adsorption roller 52 is pressed against the transfer drum 51 when the rear edge part of the recording paper 6 adsorbed to the transfer drum 51 passes the adsorption position Y' so that the rear edge part (non-image area) of the recording paper 6 and the fore edge part (non-image area) thereof which has rotated are re-adsorbed, re-adsorption periods (15) and (16) are caused as illustrated in FIG. 15.

Figure 14:
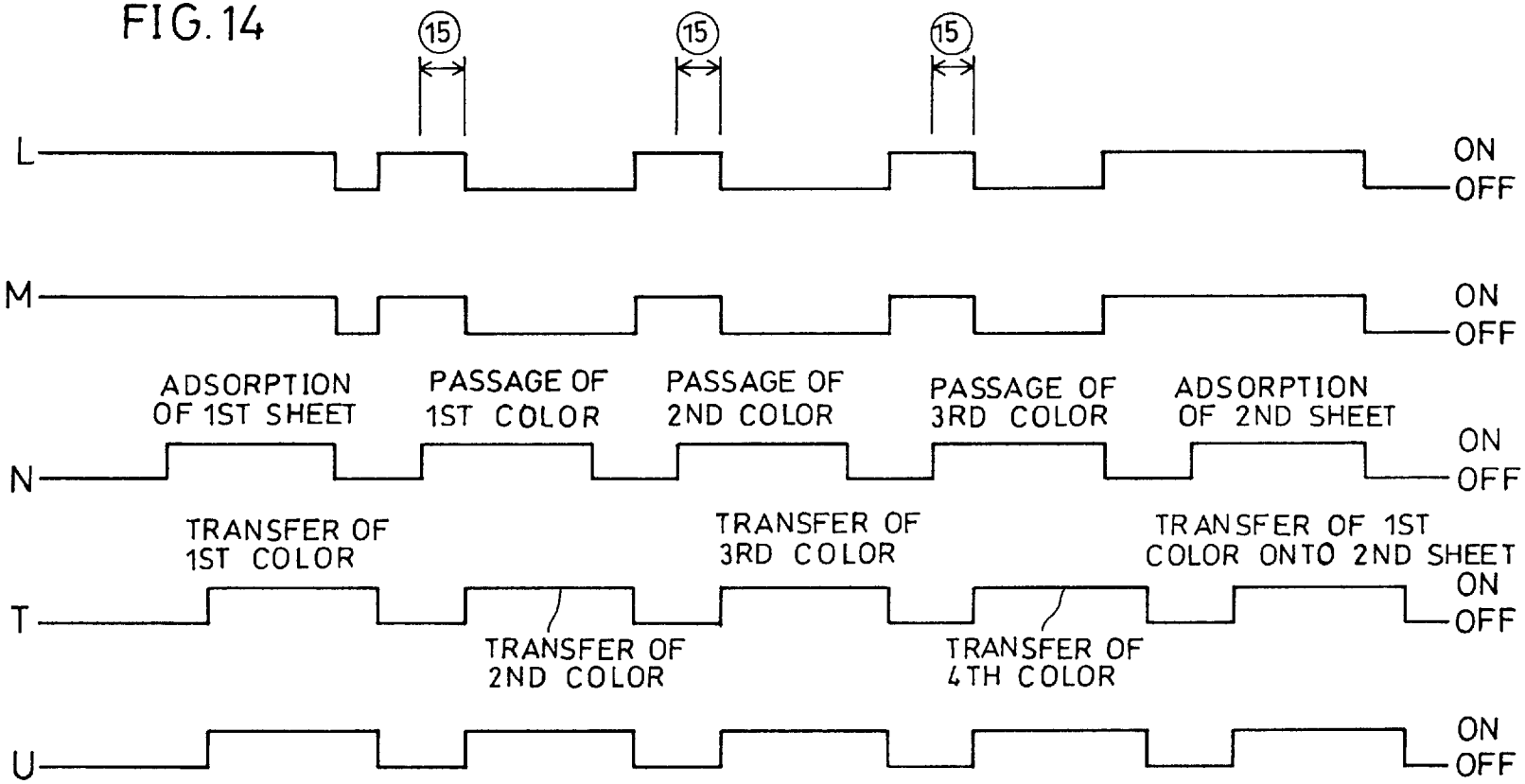
FIG. 14 is a timing chart illustrating the timings of re-adsorption, in the case where only a fore edge part of the recording paper is re-adsorbed.

As described, by providing the re-adsorption period (15), it is surely avoidable that the recording paper 6 inadequately comes off from the transfer drum 51. Particularly, providing both the re-adsorption periods (15) and (16) is effectual in the case where the recording paper 6 is thick. Note that FIGS. 14 and 15 are timing charts in the case where Ls<Lp, but the same are applicable in the case where Ls≧Lp.

[Fourth Embodiment]

Figure 16:
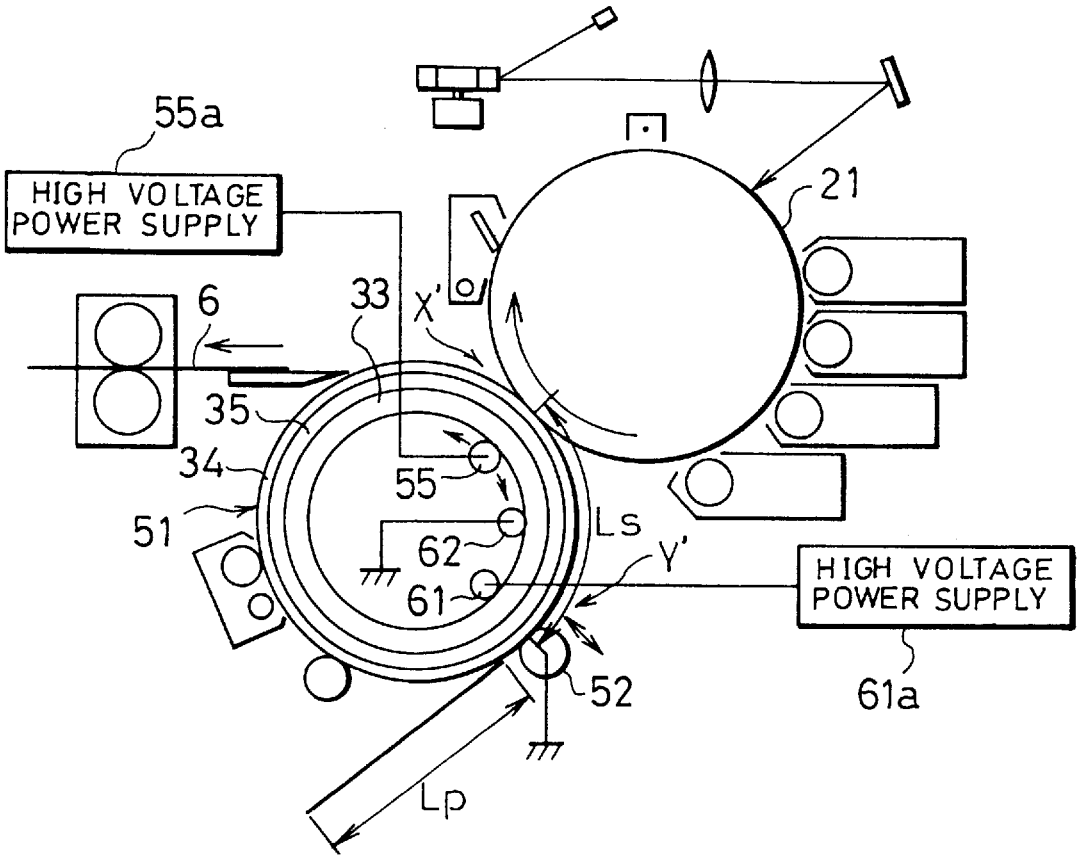
FIG. 16 is a cross-sectional view illustrating an arrangement of an image forming apparatus in accordance with still another embodiment of the present invention.

The following description will discuss another embodiment of the present invention, while referring to FIG. 16. The members having the same structure (function) as those shown in the figures for the above-mentioned first through third embodiments will be designated by the same reference numerals and their description will be omitted. The other members are the same as those of the image forming apparatus 50 of the third embodiment.

The image forming apparatus of the present embodiment has an adsorption voltage applying roller 61 as shown in FIG. 16, instead of the adsorption grounded roller 54 shown in FIG. 10 for the third embodiment. The adsorption voltage applying roller 61 is connected with a high voltage power supply 61*a*, while the adsorption roller 52 is grounded. In short, an adsorption voltage is applied in a manner reverse to that of the third embodiment, namely, from inside the transfer drum 51.

There is provided a grounded roller 62 (grounded electrode) between the transfer voltage applying roller 55 and the adsorption voltage applying roller 61. With this arrangement, it is possible to eliminate mutual interference which occurs due to that both a transfer voltage and an adsorption voltage are applied from inside the transfer drum 51.

The adsorption voltage applying roller 61 and the grounded roller 62 are both covered with an elastic substance, as the transfer voltage applying roller 55 and the adsorption grounded roller 54 of the third embodiment. Therefore, the adsorption voltage applying roller 61 and the grounded roller 62 are stably in contact with an inner surface of the transfer drum 51.

When a voltage having a positive polarity is applied to the adsorption voltage applying roller 61 in the image forming apparatus thus arranged, the recording paper 6 is charged due to a potential difference between the adsorption voltage applying roller 61 and an adsorption roller 52 which is grounded. As a result, the recording paper 6 is electrostatically adsorbed to the transfer drum 51.

Thus, by applying the adsorption voltage from inside the transfer drum 51, it is enabled that the high voltage power supplies 55*a* and 61*a* for supplying the transfer voltage and the adsorption voltage, respectively, are integrated into one system. Therefore, in this case, the structure of the voltage supplying system can be simplified. Besides, stable supply of high voltages is ensured, since there is no need to move the adsorption voltage applying roller 61 so as to contact the transfer drum 51.

[Fifth Embodiment]

Figure 17:
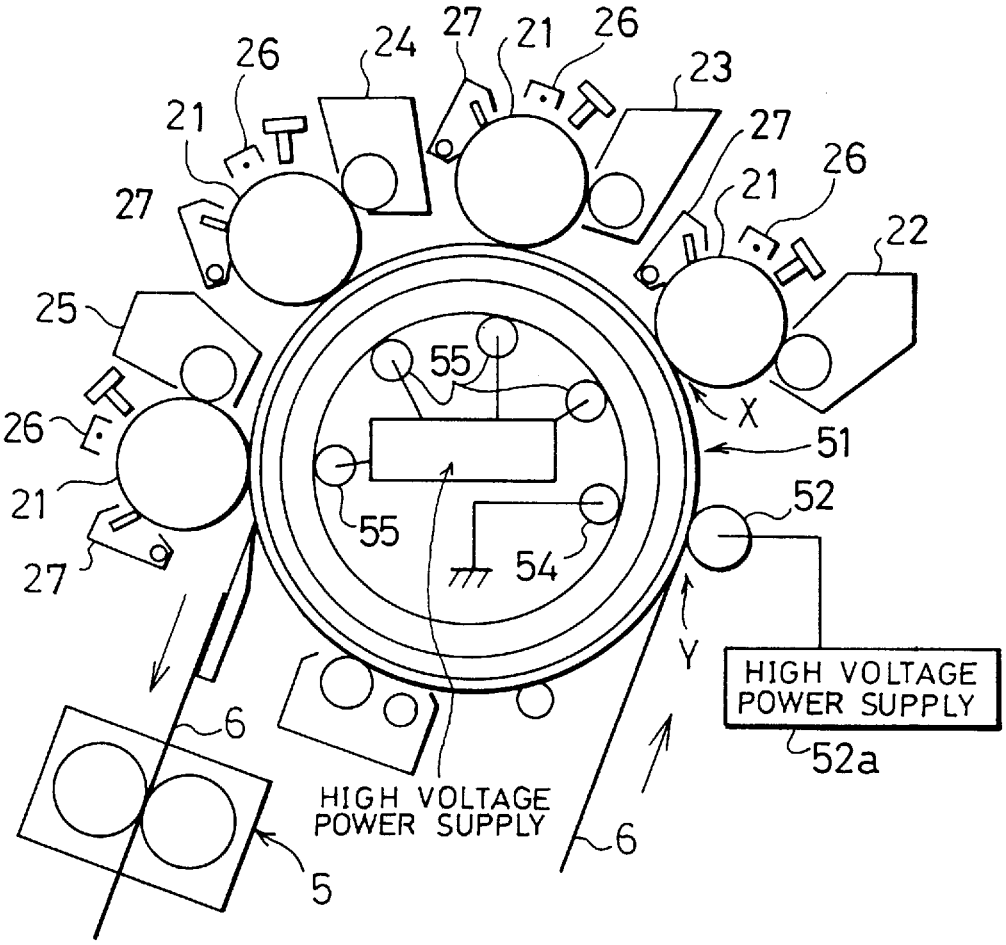
FIG. 17 is a cross-sectional view illustrating an arrangement of an image forming apparatus in accordance with still another embodiment of the present invention.
Figure 18:
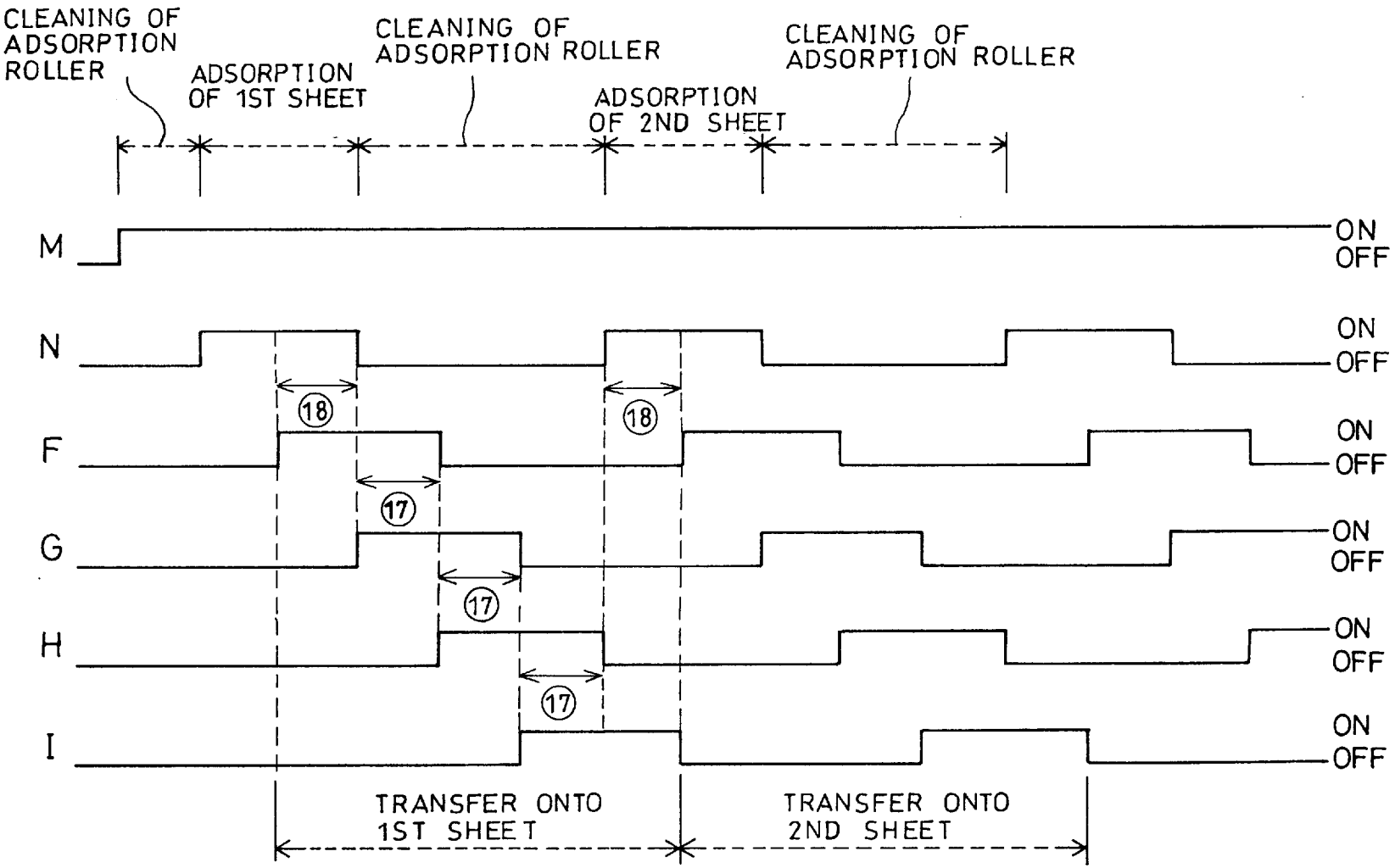
FIG. 18 is a timing chart illustrating timings of the absorption and the transfer in the above image forming apparatus.
Figure 19:
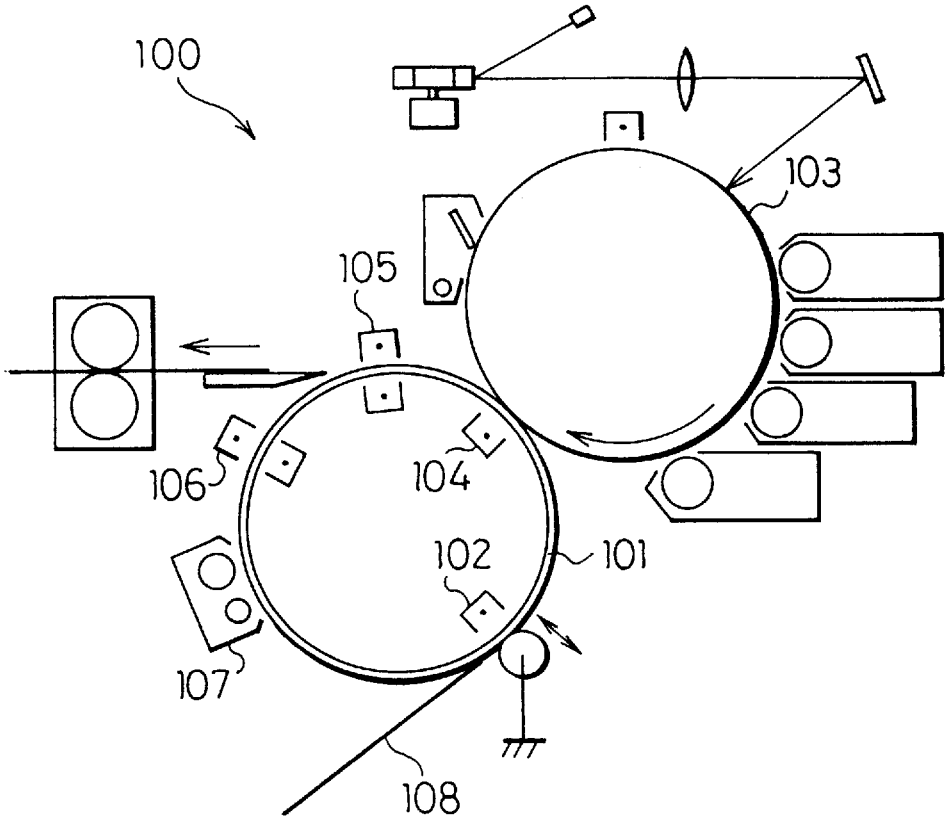
FIG. 19 is a cross-sectional view illustrating principal parts of a conventional image forming apparatus.
Figure 20:
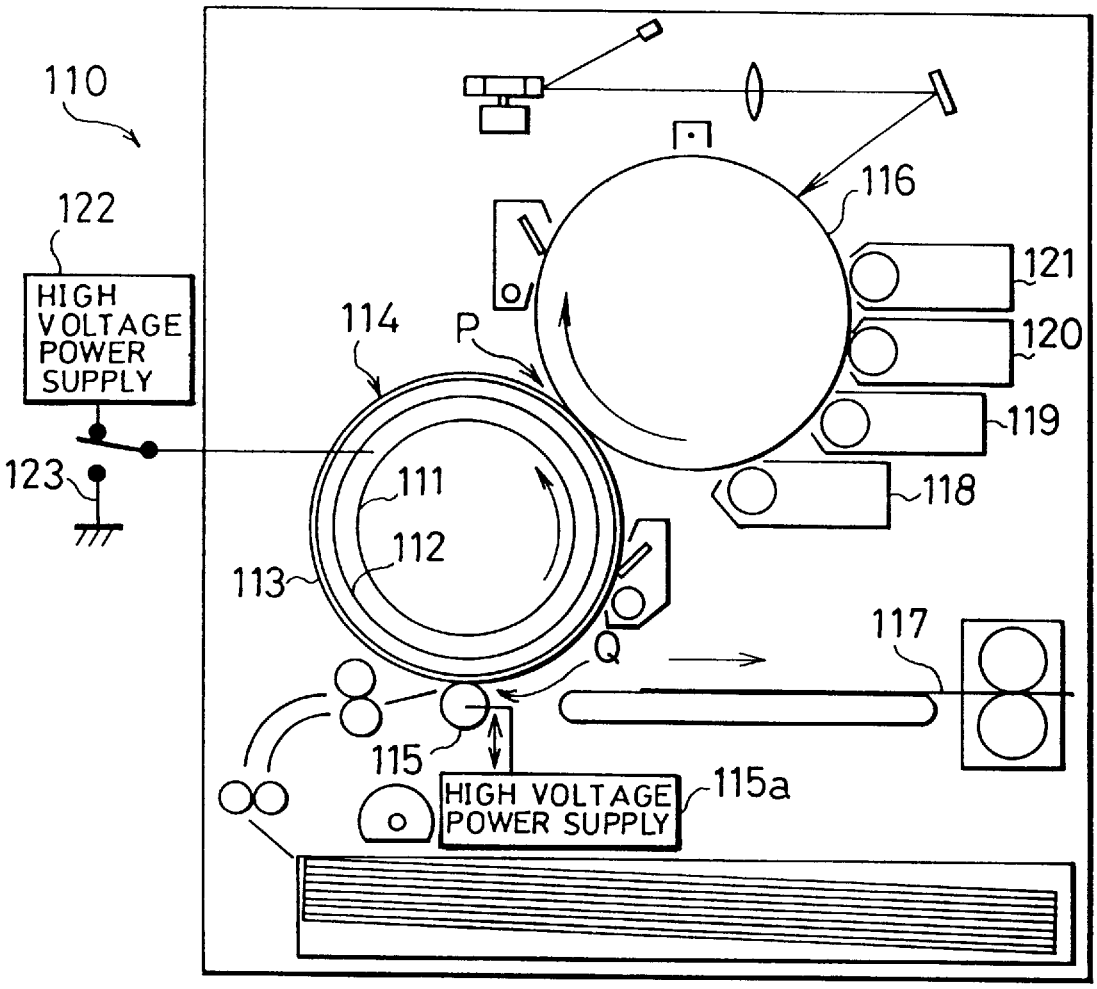
FIG. 20 is a cross-sectional view illustrating an arrangement of a conventional image forming apparatus.
Figure 21:
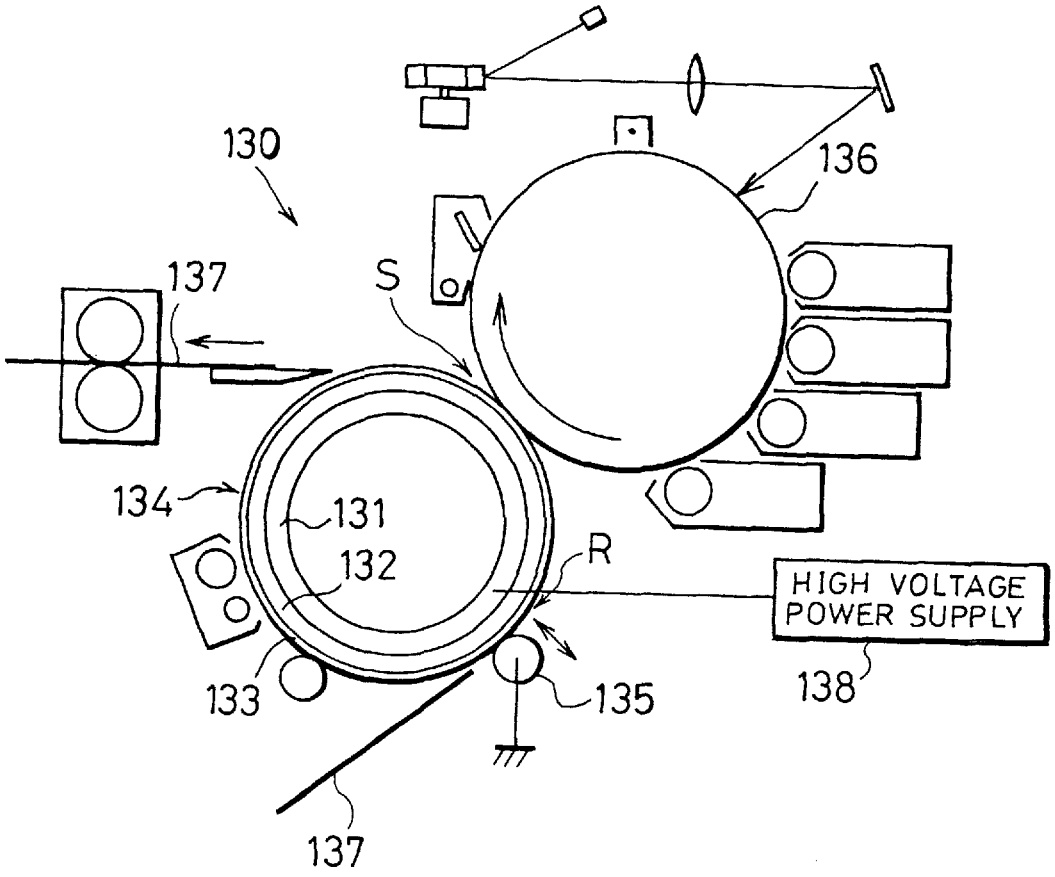
FIG. 21 is a cross-sectional view illustrating another arrangement of the conventional image forming apparatus.

The following description will discuss still another embodiment of the present invention, while referring to FIGS. 17 and 18. The members having the same structure (function) as those shown in the figures for the above-mentioned first through fourth embodiments will be designated by the same reference numerals and their description will be omitted.

As illustrated in FIG. 17, four photosensitive drums 21 are provided around the transfer drum 51, so that monochromatic toner images of four colors are formed on the photosensitive drums 21, respectively. Around each photosensitive drum 21, there are provided a charger 26, exposure means, one of development units 22 through 25, and a cleaning unit 27.

On an inner surface of the transfer drum 51, transfer voltage applying rollers 55 are provided at transfer positions X', respectively, so that each transfer voltage applying roller 55 is provided vis-a-vis each photosensitive drum 21. Besides, though not shown in the figure, grounded rollers are provided between each transfer voltage applying roller 55 so as to eliminate mutual interferences which affects each transfer action.

An image forming process in the image forming apparatus thus arranged will be discussed in the following description.

Before the recording paper 6 is sent out on the transport path, a voltage having the same polarity as that of the adsorption voltage is applied by the high voltage power supply 52*a* to the adsorption roller 52. In this state, the adsorption grounded roller 54, which is in contact with the inner surface of the transfer drum 51 on one hand and is grounded on the other hand plays a role as a counter electrode. Therefore, unnecessary toner particles adhering to the adsorption roller 52 are caused to return to the transfer drum 51.

Thereafter, the recording paper 6 is transported along the transport path to the adsorption position Y' between the transfer drum 51 and the adsorption roller 52. The recording paper 6 thus transported to the adsorption position Y' is charged there, and is electrostatically adsorbed to the transfer drum 51.

In parallel with the adsorption of the recording paper 6 to the transfer drum 51, latent images are respectively formed on the photosensitive drums 21 in accordance with signals, respectively, each signal corresponding to each color. Specifically, each surface of the photosensitive drums 21 is uniformly charged by each charger 26. Then, the surfaces of the photosensitive drums 21 are exposed by the exposure means, thereby causing each latent image to be formed thereon. The latent images formed on the photosensitive drums 21 are developed by the development units 22 through 25, respectively, thereby becoming monochromatic toner images having respective colors.

With the application of respective optimal transfer voltages to the transfer voltage applying rollers 55 provided in contact with the inner surface of the transfer drum 51, the monochromatic toner images are sequentially transferred onto the recording paper 6 on the transfer drum 51 so that the monochromatic toner images overlap each other thereon. The recording paper 6 is detached from the transfer drum 51 by the detaching pawl 18 after the last monochromatic toner image is transferred thereon. The recording paper 6 is sent to the fixing unit 5, where the multicolored toner image thus formed thereon is fused on the recording paper 6.

In the present embodiment, a system for pressing and setting apart the adsorption roller 52 onto and from the transfer drum 51 is not necessary. Furthermore, since the monochromatic toner images are transferred onto the recording paper 6 with respective optimal transfer voltages, it is possible to individually adjust darknesses of the colors, and it is possible to obtain color pictures of high quality with high reproducibility. Besides, an image forming speed in this case is substantially equal to that of a monochromatic copy.

The detailed timings of the adsorption of the recording paper 6 to the transfer drum 51, the transfer of toner images onto the recording paper 6, and the cleaning of the adsorption roller 52 are shown in FIG. 18. In FIG. 18, a square waveform M indicates timings at which the adsorption voltage is applied. A square waveform N indicates whether or not the recording paper 6 is present at the adsorption position Y'. Square waveforms F, G, H, and I indicate timings at which monochromatic toner images of yellow, cyanogen, magenta and black are transferred onto the recording paper 6, respectively. In the figures, periods in the ON states represent periods while the adsorption voltage is applied, while the recording paper 6 passes the adsorption position Y', and while the respective monochromatic toner images are transferred onto the recording paper 6, respectively.

According to the above arrangement, since a system for pressing and setting apart the adsorption roller 52 against and from the transfer drum 51 is not necessary, it is possible to carry out the cleaning of the adsorption roller 52 except during the adsorption operation, by applying a voltage having the same polarity as that of the adsorption voltage. There exists a period (17) while transfers of some of the monochromatic toner images onto the recording paper 6 are simultaneously carried out, and a period (18) while the adsorption and the transfer are simultaneously carried out.

In the image forming apparatus of the present embodiment, in spite of the existence of the periods (17) and (18), it is possible to individually apply respective adequate voltages for the adsorption and the transfers. Therefore, it is possible to smoothly transport the recording paper 6 as well as to effectually carry out the image formation, and hence, it is possible to obtain pictures of high quality.

Note that the control of the adsorption and transfer, which is carried out by controlling voltages in the above embodiments, may be carried out by controlling electric current.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

at least one photosensitive drum;

an intermediate transfer medium onto which a toner image formed on said photosensitive drum is transferred;

pressing means for pressing a recording medium against said intermediate transfer medium;

at least one first electrode capable of causing a first potential difference to be generated between said first electrode and said photosensitive drum, said first electrode being provided inside said intermediate transfer medium so as to be opposite to said photosensitive drum and so as to be in contact with an inner surface of said intermediate transfer medium; and a second electrode capable of causing a second potential difference to be generated between said second electrode and said pressing means, said second electrode being provided inside said intermediate transfer medium so as to be opposite to said pressing means and so as to be in contact with the inner surface of said intermediate transfer medium, wherein a first transfer and a second transfer are carried out so that image formation is carried out, during the first transfer a toner image being transferred from said photosensitive drum to said intermediate transfer medium in accordance with the first potential difference, during the second transfer a toner image being transferred from said intermediate transfer medium to the recording medium in accordance with the second potential difference.

2. The image forming apparatus as set forth in claim 1, wherein said intermediate transfer medium includes a transfer medium main body made of a semiconductive resin, and an insulating layer provided on an outer surface of the transfer medium main body.

3. The image forming apparatus as set forth in claim 1, wherein:

said pressing means applies a voltage to said intermediate transfer medium; and said second electrode is grounded.

4. The image forming apparatus as set forth in claim 1, wherein:

said pressing means is grounded; and said second electrode applies a voltage to said intermediate transfer medium.

5. The image forming apparatus as set forth in claim 1, wherein a voltage having a polarity reverse to that of the voltage for the second transfer is applied across said second electrode and said pressing means except during the second transfer.

6. The image forming apparatus as set forth in claim 1, wherein said first electrode, provided in contact with the inner surface of said intermediate transfer medium, is provided so as to be movable in an arc with respect to a center of the intermediate transfer medium.

7. The image forming apparatus as set forth in claim 1, wherein:

said photosensitive drums, on which toner images of different colors are respectively formed, are provided around said intermediate transfer medium; and said first electrodes are provided inside said intermediate transfer medium so as to be in contact with the inner surface of said intermediate transfer medium so that each first electrode and each photosensitive drum are oppositely provided.

8. The image forming apparatus as set forth in claim 1, wherein said first electrode is covered with an elastic substance.

9. The image forming apparatus as set forth in claim 1, wherein said second electrode is covered with an elastic substance.

10. The image forming apparatus as set forth in claim 1, wherein said intermediate transfer medium is arranged so as to be insulated from a main body frame of said image forming apparatus.

11. The image forming apparatus as set forth in claim 2, wherein the transfer medium main body has a volume resistivity of $10^4$ Ωcm to $10^8$ Ωcm.

12. The image forming apparatus as set forth in claim 2, wherein the transfer medium main body has a thickness of 1 mm to 30 mm.

13. The image forming apparatus as set forth in claim 2, wherein the insulating layer has a volume resistivity of $10^{12}$ Ωcm to $10^{17}$ Ωcm.

14. The image forming apparatus as set forth in claim 2, wherein the insulating layer has a thickness of 50 μm to 300 μm.

15. The image forming apparatus as set forth in claim 2, wherein the insulating layer has a dielectric constant of 8 to 12.

16. The image forming apparatus as set forth in claim 2, wherein the insulating layer is made of polyvinylidene fluoride.

17. The image forming apparatus as set forth in claim 2, wherein the insulating layer is made of polyethylene terephthalate.

18. The image forming apparatus as set forth in claim 2, wherein said intermediate transfer medium further includes a semiconductive elastic layer having rubber elasticity, between the transfer medium main body and the insulating layer.

19. An image forming apparatus as set forth in claim 4, further comprising a grounded electrode provided between said first electrode and said second electrode so as to be in contact with the inner surface of said intermediate transfer medium.

20. The image forming apparatus as set forth in claim 18, wherein said pressing means has a cylindrical shape and a hardness greater than that of the elastic layer.

21. The image forming apparatus as set forth in claim 18, wherein the elastic layer has a volume resistivity of $10^4$ Ωcm to $10^8$ Ωcm.

22. The image forming apparatus as set forth in claim 18, wherein the elastic layer has a thickness of 1 mm to 10 mm.

23. The image forming apparatus as set forth in claim 19, wherein said grounded electrode is covered with an elastic substance.

24. An image forming apparatus comprising:

at least one photosensitive drum;

a transfer medium for holding a recording medium and for transporting the recording medium to said photosensitive drum;

pressing means for pressing the recording medium against said transfer medium;

at least one first electrode capable of causing a first potential difference to be generated between said first electrode and said photosensitive drum, said first electrode being provided inside said transfer medium so as to be opposite to said photosensitive drum and so as to be in contact with an inner surface of said transfer medium; and a second electrode capable of causing a second potential difference to be generated between said second electrode and said pressing means, said second electrode being provided inside said transfer medium so as to be opposite to said pressing means and so as to be in contact with the inner surface of said transfer medium, wherein the recording medium is adsorbed to said transfer medium in accordance with the second potential difference, while a toner image formed on said photosensitive drum is transferred onto the recording medium adsorbed to said transfer medium in accordance with the first potential difference.

25. The image forming apparatus as set forth in claim 24, wherein said transfer medium includes a transfer medium main body made of a semiconductive resin, and an insulating layer provided on an outer surface of the transfer medium main body.

26. The image forming apparatus as set forth in claim 24, wherein:

said pressing means applies a voltage to said transfer medium; and said second electrode is grounded.

27. The image forming apparatus as set forth in claim 24, wherein:

said pressing means is grounded; and said second electrode applies a voltage to said transfer medium.

28. The image forming apparatus as set forth in claim 24, wherein a voltage having a polarity reverse to that of the voltage applied during the adsorption of the recording medium to said transfer medium is applied across said second electrode and said pressing means except during the adsorption.

29. The image forming apparatus as set forth in claim 24, wherein, when the recording medium adsorbed to said transfer medium is again transported to an adsorption region between said pressing means and said second electrode with the rotation of said transfer medium, a fore edge part of the recording medium with respect to a rotation direction of said transfer medium is again adsorbed to said transfer medium in accordance with the second potential difference.

30. The image forming apparatus as set forth in claim 24, wherein, when the recording medium adsorbed to said transfer medium is again transported to an adsorption region between said pressing means and said second electrode with the rotation of said transfer medium, a fore edge part and a rear edge part of the recording medium with respect to a rotation direction of said transfer medium are again adsorbed to said transfer medium in accordance with the second potential difference.

31. The image forming apparatus as set forth in claim 24, wherein said first electrode, provided in contact with the inner surface of said transfer medium, is provided so as to be movable in an arc with respect to a center of the transfer medium.

32. The image forming apparatus as set forth in claim 24, wherein:

said photosensitive drums, on which toner images of different colors are respectively formed, are provided around said transfer medium; and said first electrodes are provided inside said transfer medium so as to be in contact with the inner surface of said transfer medium so that each first electrode and each photosensitive drum are oppositely provided.

33. The image forming apparatus as set forth in claim 24, wherein said first electrode is covered with an elastic substance.

34. The image forming apparatus as set forth in claim 24, wherein said second electrode is covered with an elastic substance.

35. The image forming apparatus as set forth in claim 24, wherein said transfer medium is arranged so as to be insulated from a main body frame of said image forming apparatus.

36. The image forming apparatus as set forth in claim 25, wherein the transfer medium main body has a volume resistivity of $10^4$ Ωcm to $10^8$ Ωcm.

37. The image forming apparatus as set forth in claim 25, wherein the transfer medium main body has a thickness of 1 mm to 30 mm.

38. The image forming apparatus as set forth in claim 25, wherein the insulating layer has a volume resistivity of $10^{12}$ Ωcm to $10^{17}$ Ωcm.

39. The image forming apparatus as set forth in claim 25, wherein the insulating layer has a thickness of 50 μm to 300 μm.

40. The image forming apparatus as set forth in claim 25, wherein the insulating layer has a dielectric constant of 8 to 12.

41. The image forming apparatus as set forth in claim 25, wherein the insulating layer is made of polyvinylidene fluoride.

42. The image forming apparatus as set forth in claim 25, wherein the insulating layer is made of polyethylene terephthalate.

43. The image forming apparatus as set forth in claim 25, wherein said transfer medium further includes a semiconductive elastic layer having rubber elasticity, between the transfer medium main body and the insulating layer.

44. An image forming apparatus as set forth in claim 27, further comprising a grounded electrode provided between said first electrode and said second electrode so as to be in contact with the inner surface of said transfer medium.

45. The image forming apparatus as set forth in claim 43, said pressing means has a hardness smaller than that of the elastic layer.

46. The image forming apparatus as set forth in claim 43, wherein the elastic layer has a volume resistivity of $10^4$ Ωcm to $10^8$ Ωcm.

47. The image forming apparatus as set forth in claim 43, wherein the elastic layer has a thickness of 1 mm to 10 mm.

48. The image forming apparatus as set forth in claim 44, wherein said grounded electrode is covered with an elastic substance.

* * * * *